US006057787A

United States Patent [19]

Kell et al.

[11] Patent Number: 6,057,787

[45] Date of Patent: May 2, 2000

[54] AUTOMATIC SAFETY FLAG FOR BOATS AND WATER RECREATIONAL VEHICLES

[76] Inventors: Lloyd Aubrey Kell; Jan L. Hernandez-Kell, both of 12548 Nasturtium Dr., Rancho Cucamonga, Calif. 91739

[21] Appl. No.: 08/982,498

[22] Filed: Dec. 2, 1997

[51] Int. Cl.[7] ..... G08B 23/00

[52] U.S. Cl. ..... 340/984; 114/343; 116/173

[58] Field of Search ..... 340/984, 321, 340/432, 472; 114/343, 270; 116/26, 173; 362/61

[56] References Cited

U.S. PATENT DOCUMENTS

| | | | |
|---|---|---|---|
| 3,602,188 | 8/1971 | Penaflor | 114/253 |
| 3,664,189 | 5/1972 | Weinstein | 73/185 |
| 4,856,452 | 8/1989 | Pingel et al. | 114/343 |
| 4,914,946 | 4/1990 | Nakamura et al. | 340/984 |
| 4,962,720 | 10/1990 | Leffel | 116/173 |
| 5,304,993 | 4/1994 | Handsaker | 340/984 |

*Primary Examiner*—Brent A. Swarthout

*Attorney, Agent, or Firm*—Robert N. Schlesinger

[57] ABSTRACT

This Automatic Safety Flag for Boats and Water Recreational Vehicles relates to a system that automatically raises and lowers a flag mast, which may be telescoping, and with a safety flag located at or near the terminal end of said mast, located on said boat or water vehicle. The flag mast automatically raises the flag when the velocity of the boat or vehicle is traveling below approximately 5 miles per hour or is traveling at a wakeless velocity, and the mast automatically lowers when the boat or water vehicle velocity is above approximately 5 miles per hour. There are two sets of embodiments disclosed. The electromechanical embodiment utilizes an electric motor to automatically raise and to lower the flag mast at said desired water vehicle velocities, and said motor is controlled electrically by a speed transducer, speedometer, or the like. The fluidic embodiment utilizes fluidic or water pressure in the system to keep the flag mast in the lowered position when the water vehicle velocity is approximately 5 miles per hour or greater, and when said velocity drops below approximately 5 miles per hour or when the vehicle is travelling at a wakeless velocity, a loaded band spring will cause the flag mast to raise.

15 Claims, 41 Drawing Sheets

AUTOMATIC SAFETY FLAG FOR BOATS AND WATER RECREATIONAL VEHICLES

BACKGROUND—FIELD OF THE INVENTION

This invention was devised and invented by Lloyd Kell and Jan Kell, and relates to a system that automatically raises and lowers a flag pole or mast (12), which may be telescoping, and with a safety flag (13) located at its terminal end, and said mast (12) being located on a boat or other water recreational vehicle (1). The flag mast (12) automatically raises when the velocity of the water vehicle (1) is traveling below approximately 5 miles per hour ("MPH") or is traveling at a wakeless velocity, and the mast (12) automatically lowers when the vehicle (1) is above approximately 5 MPH.

Throughout this specification and its appended claims, the invention disclosed herein, entitled the "Automatic Safety Flag for Boats and Water Recreational Vehicles" will be referred to as the "Automatic Safety Flag". The Automatic Safety Flag may be installed as a device into a water vehicle (1) at the time of manufacture or said vehicle (1), or may be installed or retrofitted at a later time into the water vehicle (1), and in which case is referred to as the Automatic Safety Flag device. The Automatic Safety Flag may also be marketed as a kit and may then be installed or retrofitted into a water vehicle (1), and in which case is referred to as the Automatic Safety Flag kit. Throughout this specification and its appended claims, the term Automatic Safety Flag is intended to refer to embodiments of the invention, whether a kit or an installed device.

Throughout this specification and its appended claims, the term "vehicle" or the term "water vehicle", is intended to mean boat, ship, water vessel, skiff, dory, launch, gondola, watercraft, jet ski, wave runner, and other water recreational vehicles and personal watercraft.

There are two described embodiments of the invention for raising and lowering the flag mast or pole (12), The first embodiment is electromechanical, whereby an electric motor (17) automatically raises or lowers the flag mast (12) at the desired water vehicle (1) velocities cited above, and whereby said motor (17) is controlled electrically by a speed transducer, speedometer, or the Like. The second embodiment is fluid mechanical, whereby the fluidic or water pressure in the Automatic Safety Flag device or system Keeps the flag mast (13) in the lowered position when the water vehicle's (1) velocity is approximately 5 MPH or greater, and when said water vehicle's (1) velocity drops below approximately 5 MPH or is travelling at a wakeless velocity, a loaders hand spring (52) will cause the flag mast (12) to raise. The fluidic pressure in this fluid mechanical embodiment of the Automatic Safety Flag is determined by the velocity of the water vehicle (1).

DESCRIPTION OF PRIOR ART AND NEED FOR THE PRESENT INVENTION

A primary application of this invention is to automatically raise and lower a safety flag (13) located at or near the terminal end of a flag mast (12), and which is located prominently on the water vehicle (1), as required by law or as desired by the user.

The primary purpose of the present Automatic Safety Flag invention is to alert any water vehicle (1) in the vicinity, that another water vehicle (1) is proceeding at a low velocity or wakeless speed, or that it may be in a non-operational state. This Automatic Safety Flag invention can also aid in allowing authorities to easily detect speed violators by the absence of such a safety flag (13), and which is extremely helpful in a marina, water recreational area, or a wakeless speed area. Another primary purpose of the present Automatic Safety Flag invention is to save lives and to help prevent injuries by making all water vehicles (1) more visible to other water vehicles (1), and to the authorities.

DRAWING FIGURES

The drawing figures reflect preferred embodiments of the Automatic Safety Flag, unless otherwise stated, and as is intended for use with water vehicles (1), but the present invention is not limited to such use.

Figure 1:
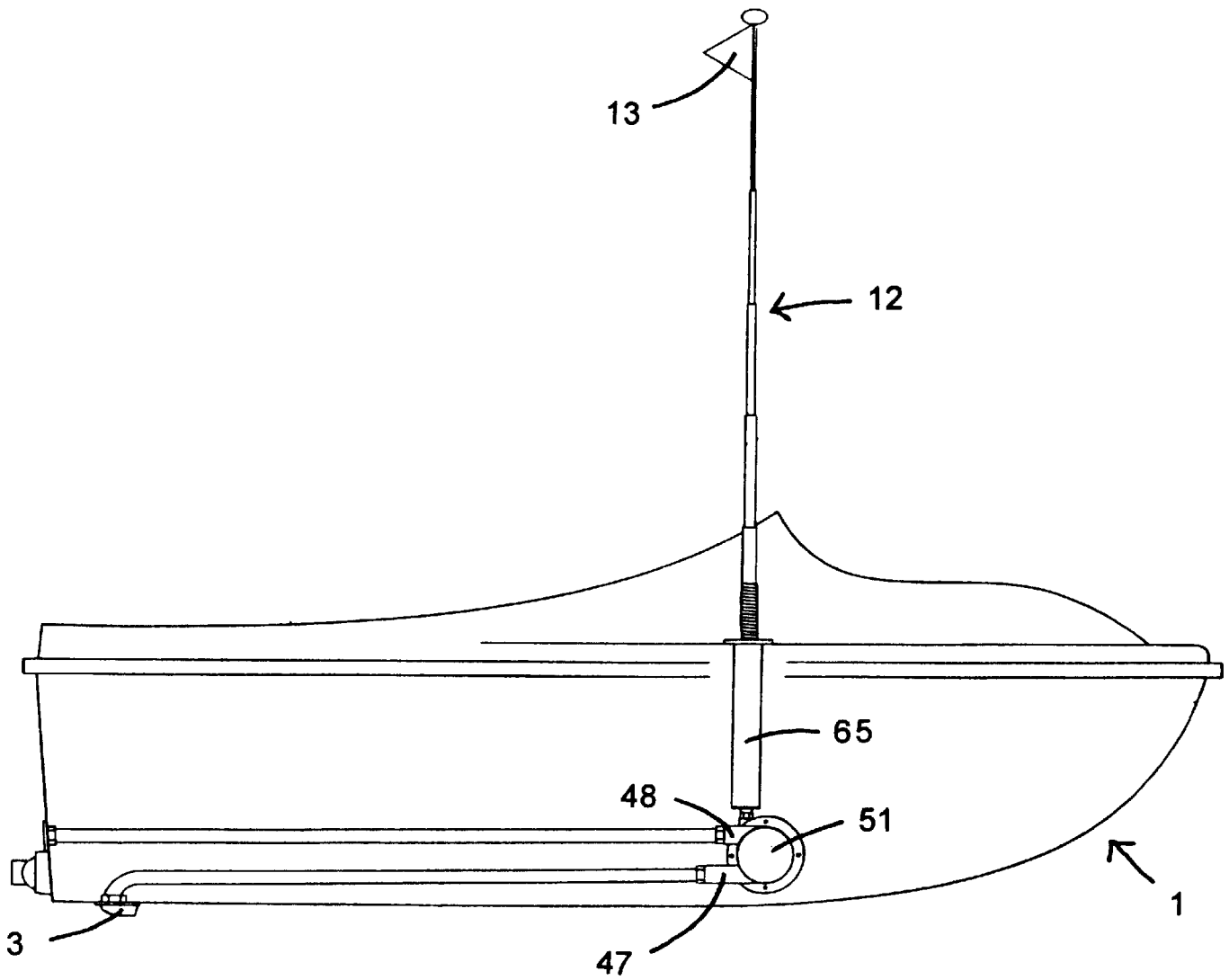
FIG. 1 shows a plan view of a water vehicle (1) with the fluid mechanical embodiment of the Automatic Safety Flag device incorporated therein, and showing the flag mast (12) in the extended position.
Figure 2:
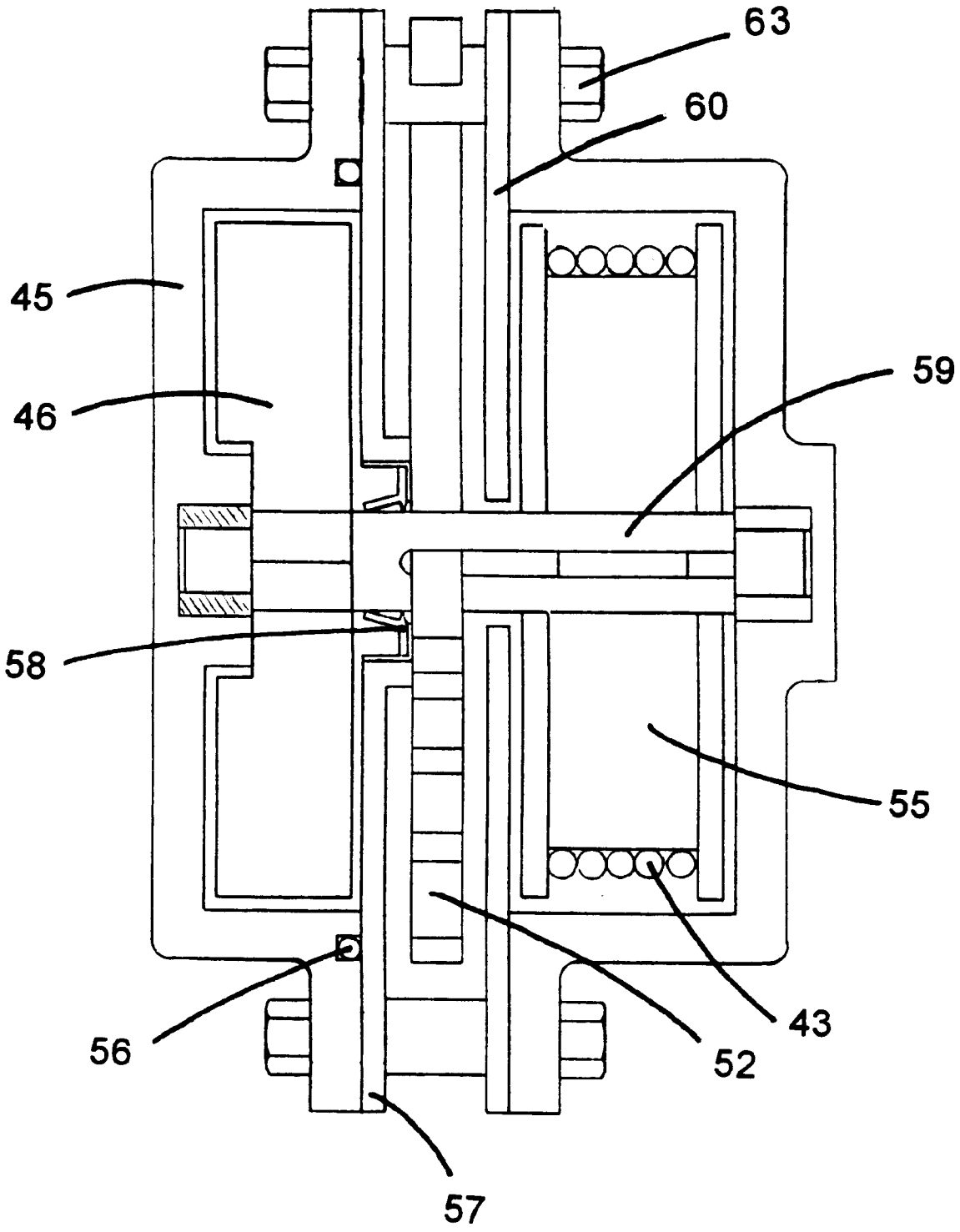
FIG. 2 shows a sectional side view of some key elements of the fluid mechanical embodiment of the Automatic Safety Flag device, including the impeller housing (45) assembly with the spline pulley (55), mast cable (43), band spring (52), and the housing assembly bolts (63).
Figure 3:
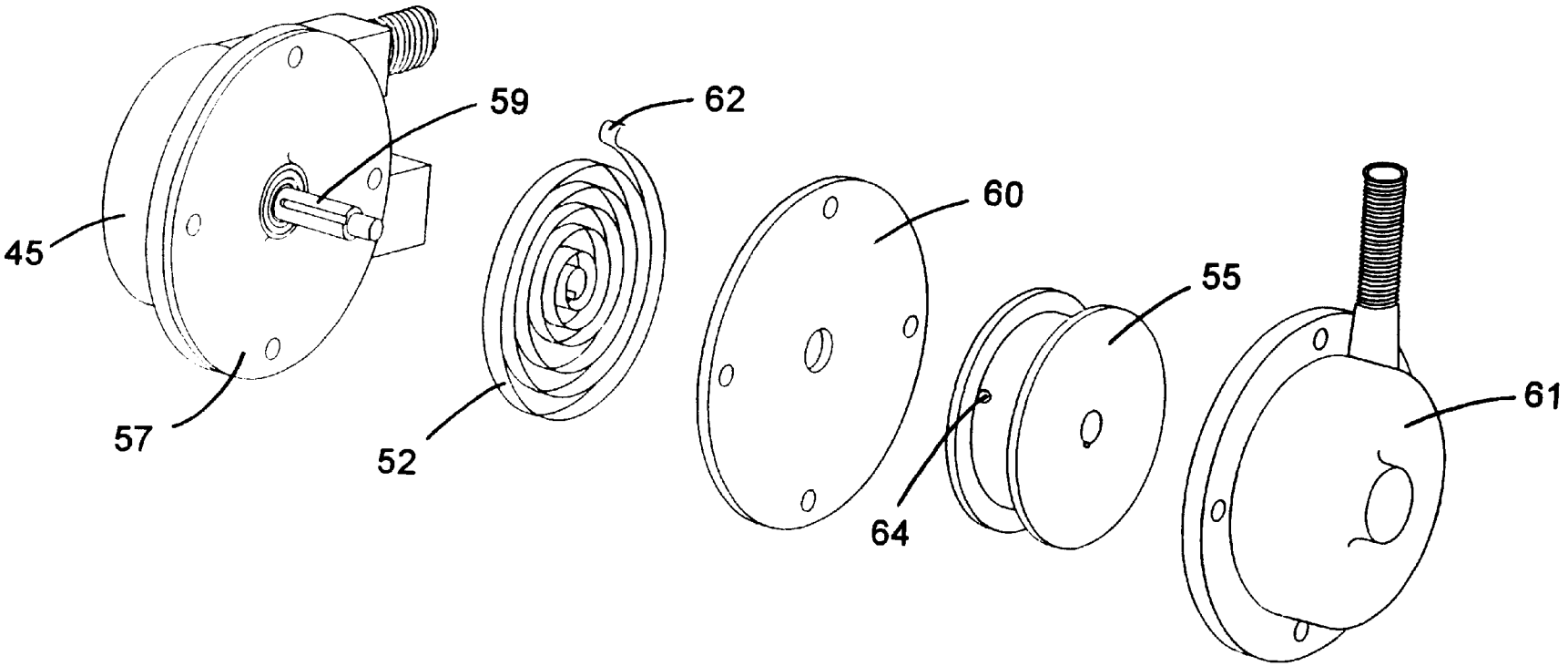
FIG. 3 shows an exploded front view of the fluid mechanical embodiment, and showing the back side of the impeller housing (45), the band spring (52) and band spring cover plate (60), the spline pulley (55), and the spline pulley cover (61).
Figure 4:
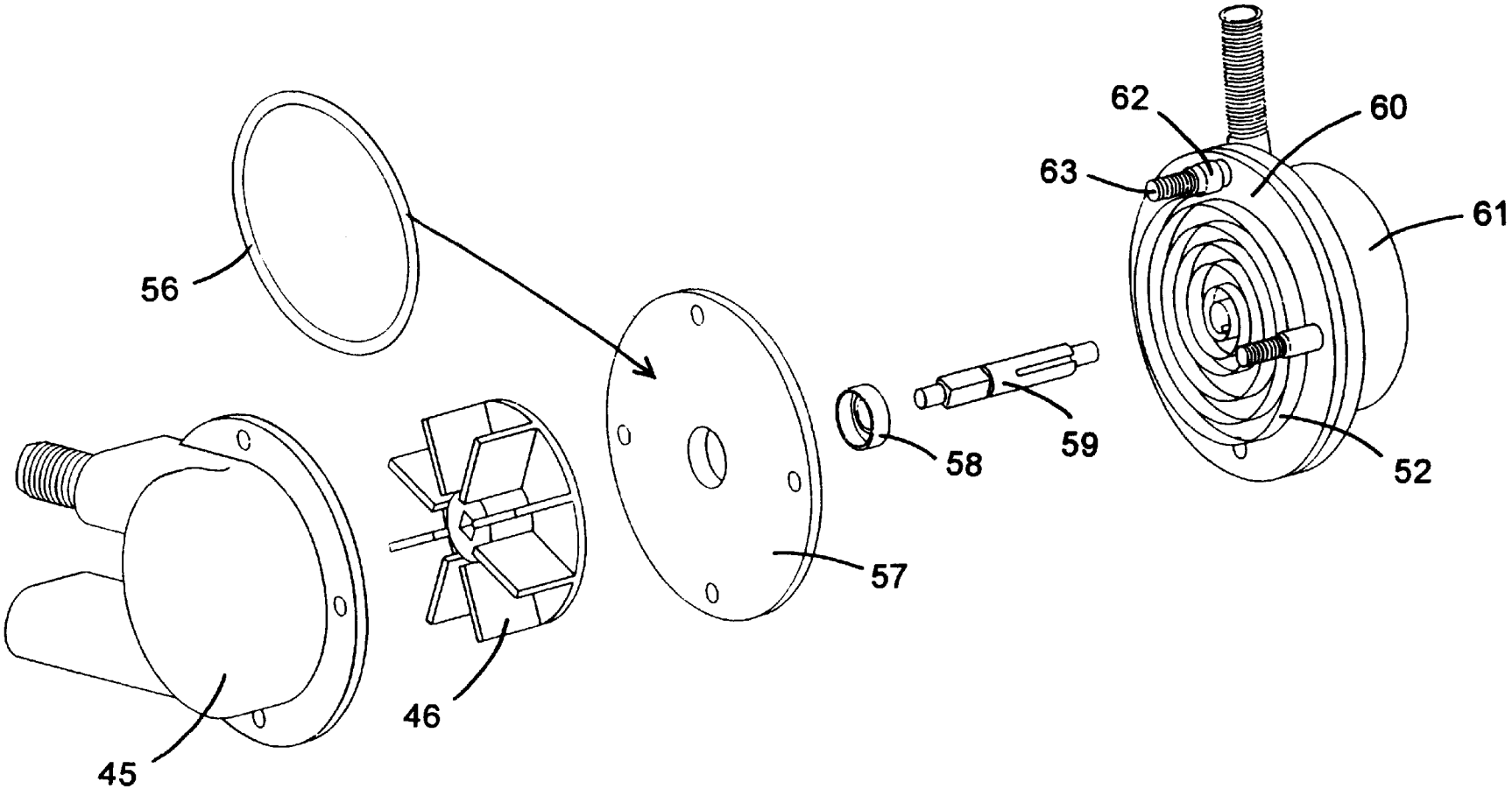

FIG. 4 shows an exploded rear view of the fluid mechanical embodiment, and showing the front side of the impeller housing (45), the impeller (46), the O-ring seal (56) which located between said impeller housing (46) and the impeller cover plate (57), the spline shaft seal (58) which is placed within the central orifice of said impeller cover plate (57) and over the spline pulley shaft (59), the opposite end of said spline pulley shaft (59) being set within the band spring housing assembly (51).

Figure 5:
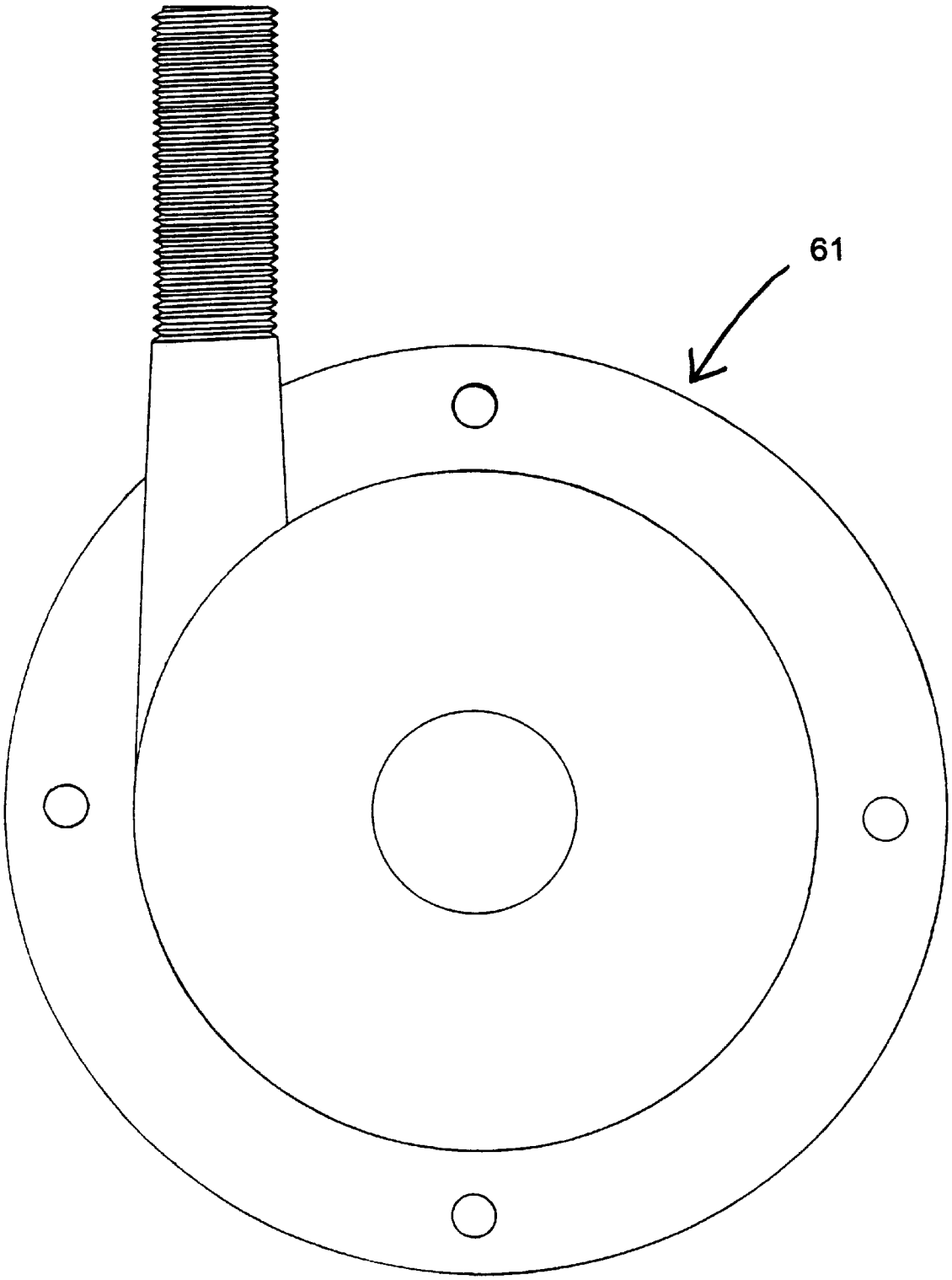

FIG. 5 shows a front view of the spline pulley cover (61) for housing the spline pulley (55), band spring cover plate (60), and band spring (52).

Figure 6:
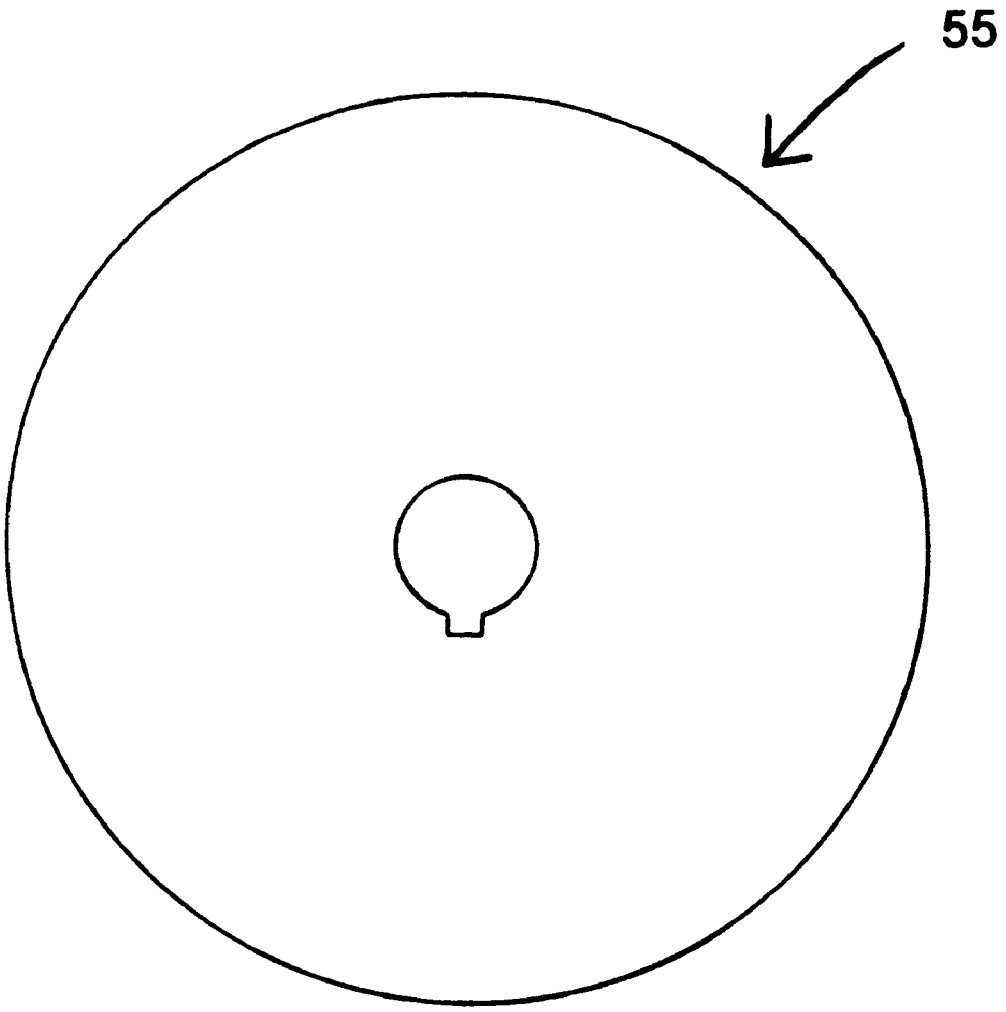

FIG. 6 shows a side view of the spline pulley (55).

Figure 7:
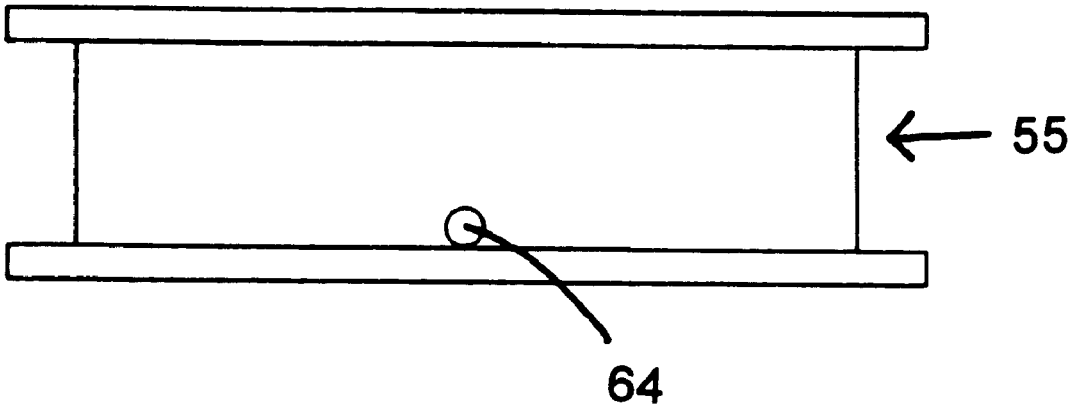

FIG. 7 shows an end view of the spline pulley (55), and showing the mast cable orifice (64) for inserting and connecting the mast cable (43), and said mast cable not shown.

Figure 8:
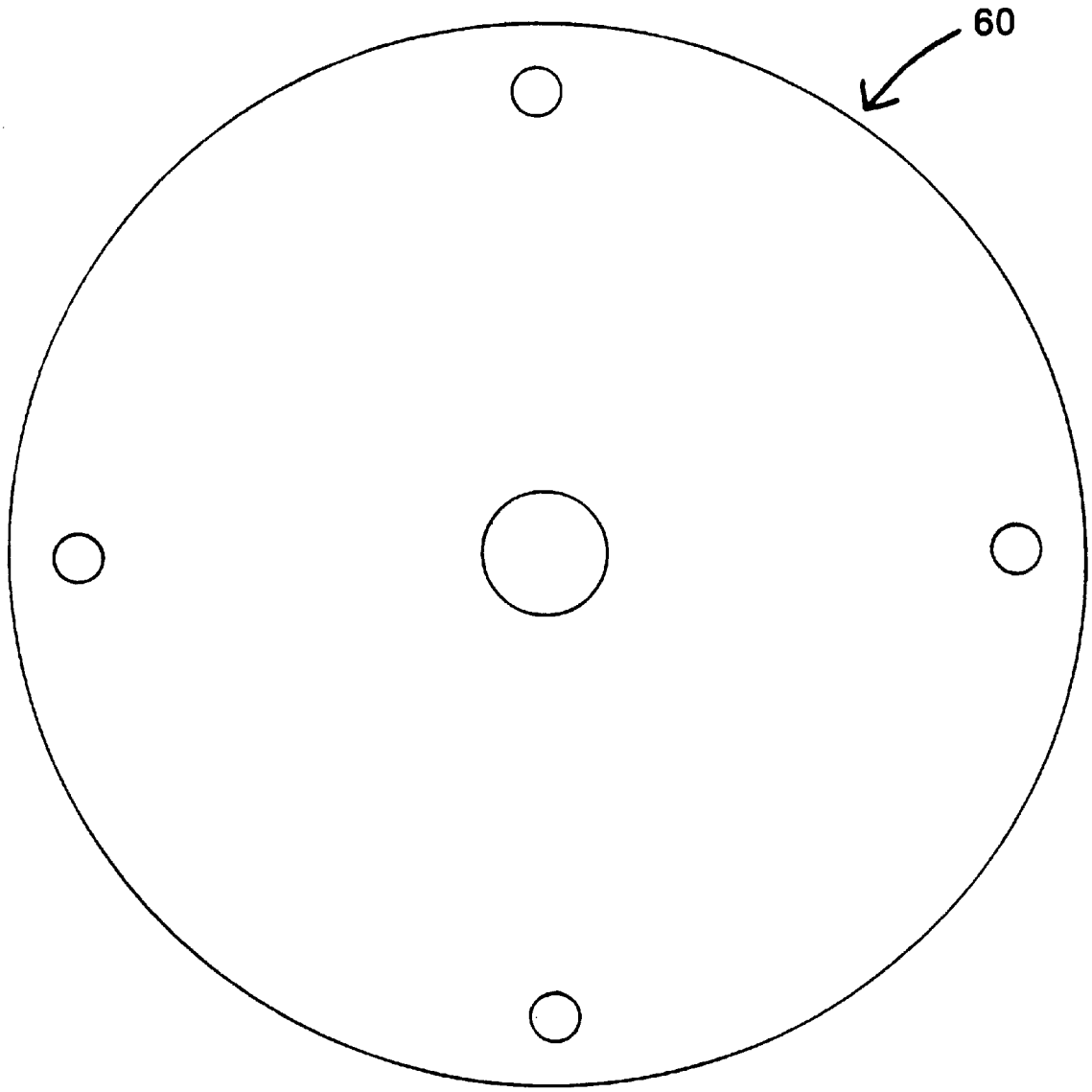

FIG. 8 shows a side view of the band spring cover plate (60).

Figure 9:
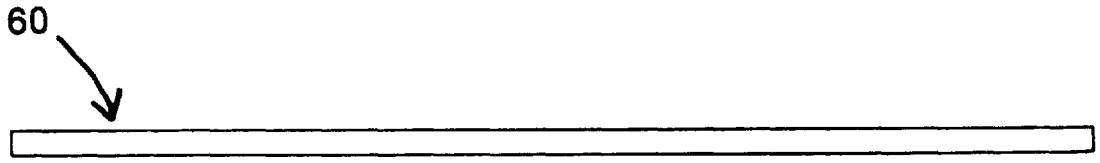

FIG. 9 shows and end view of said band spring cover plate (60).

Figure 10:
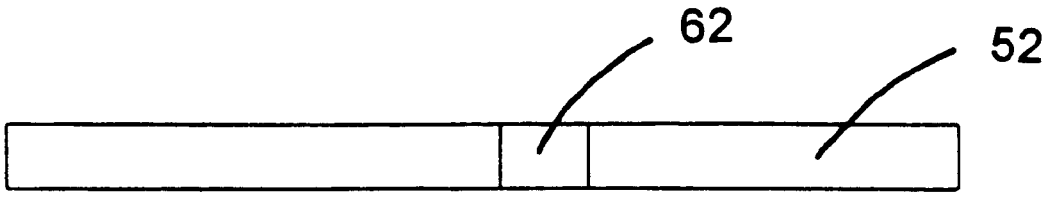

FIG. 10 shows an end view of the band spring (52), and showing the tail end of said band spring (62), the opposite end view of the band spring (52) not showing said tail end (62).

Figure 11:
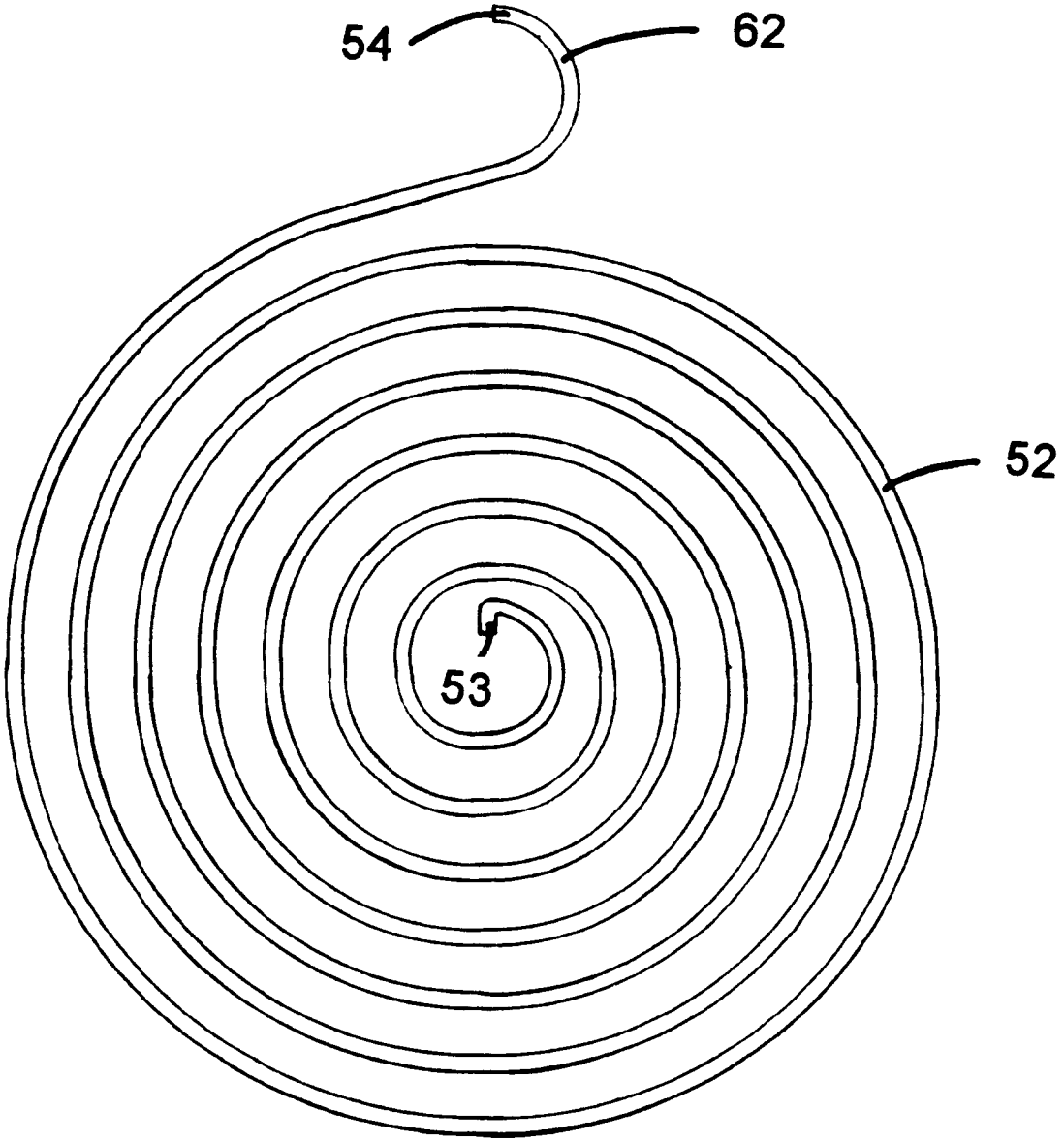

FIG. 11 shows a front view of the band spring (52).

Figure 12:
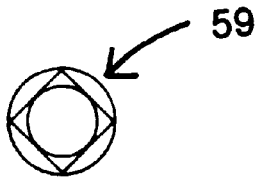

FIG. 12 shows a left end view of the spline pulley shaft (59).

Figure 13:
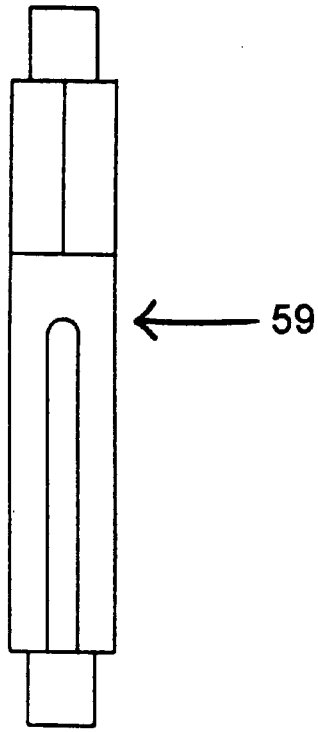

FIG. 13 shows a side view of the spline pulley shaft (59).

Figure 14:
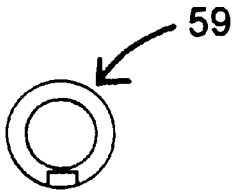

FIG. 14 shows a right end view of the spline pulley shaft (59).

Figure 15:
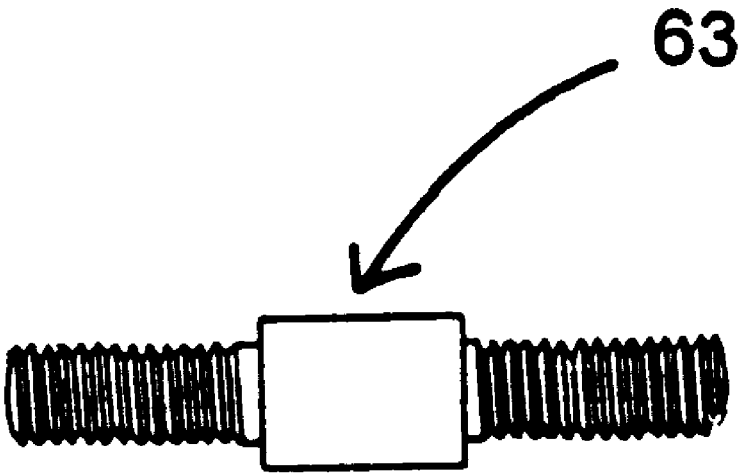

FIG. 15 shows a side view of the housing assembly bolt (63).

Figure 16:
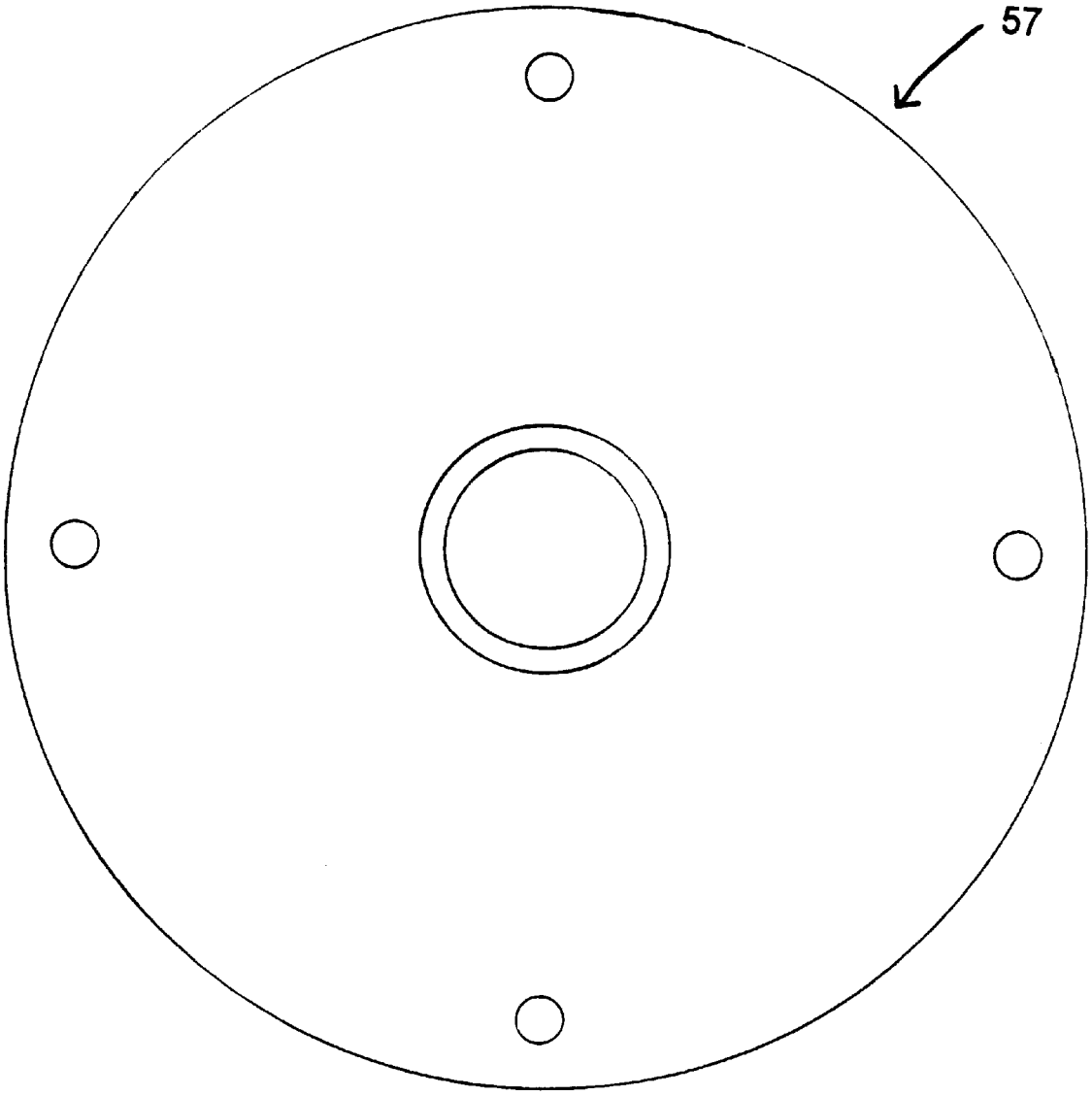

FIG. 16 shows a front view of the impeller cover plate (57).

Figure 17:
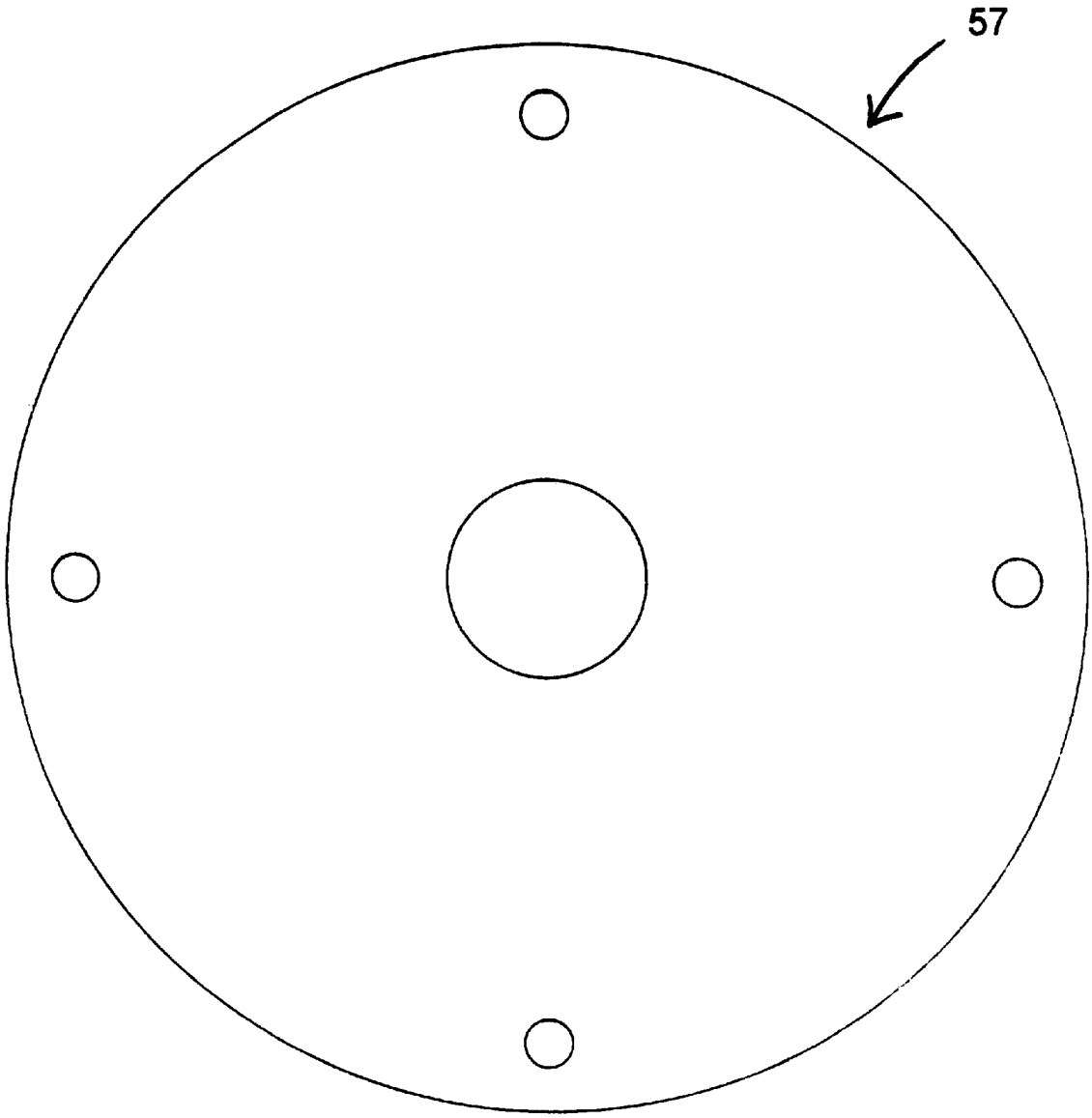

FIG. 17 shows a rear view of said impeller cover plate (57).

Figure 18:
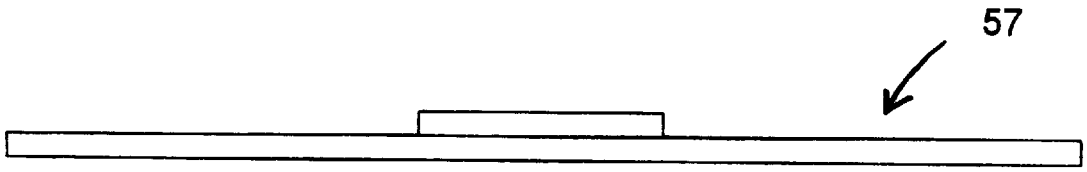

FIG. 18 shows an end view of the impeller cover plate (57).

Figure 19:
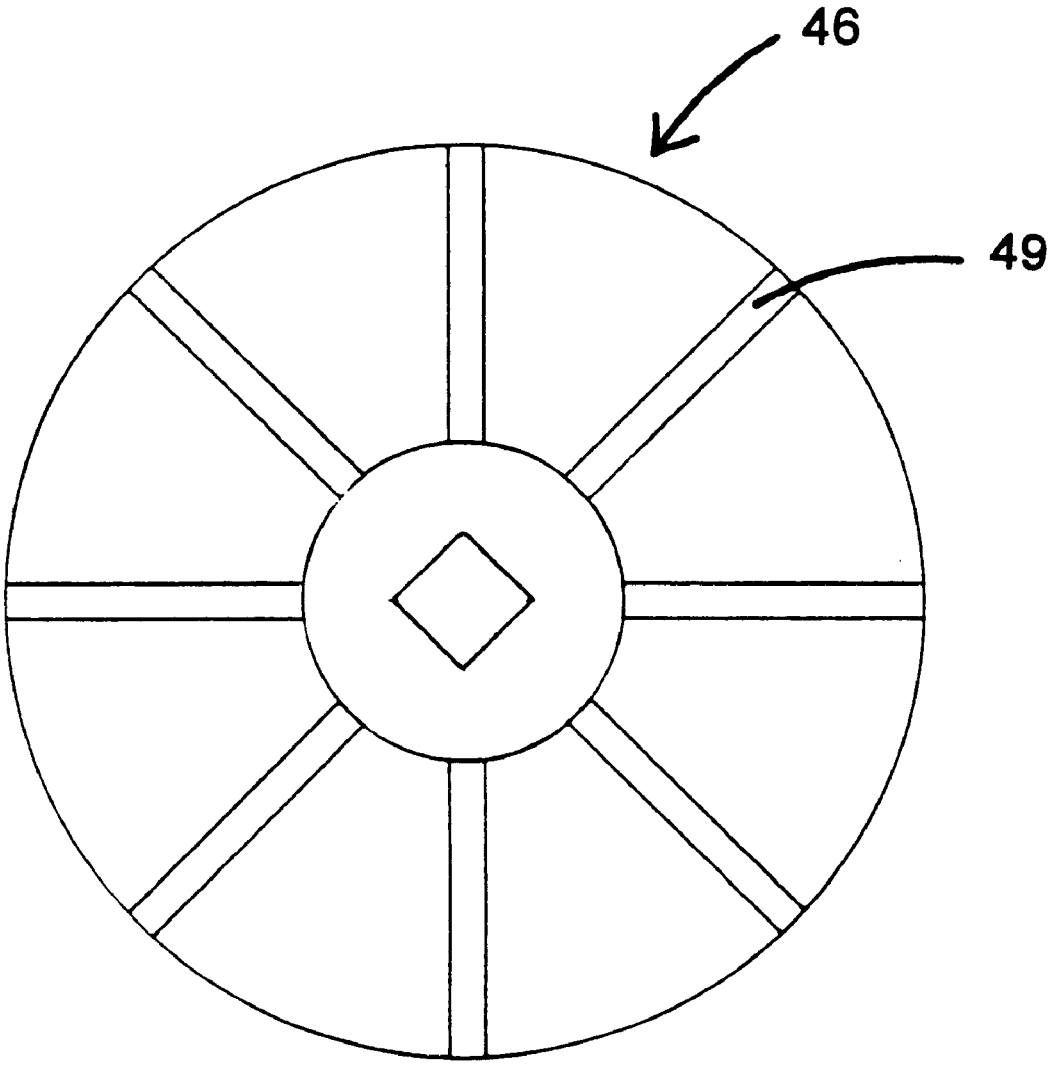

FIG. 19 shows a side view of the impeller (46), and showing the impeller blades (49).

Figure 20:
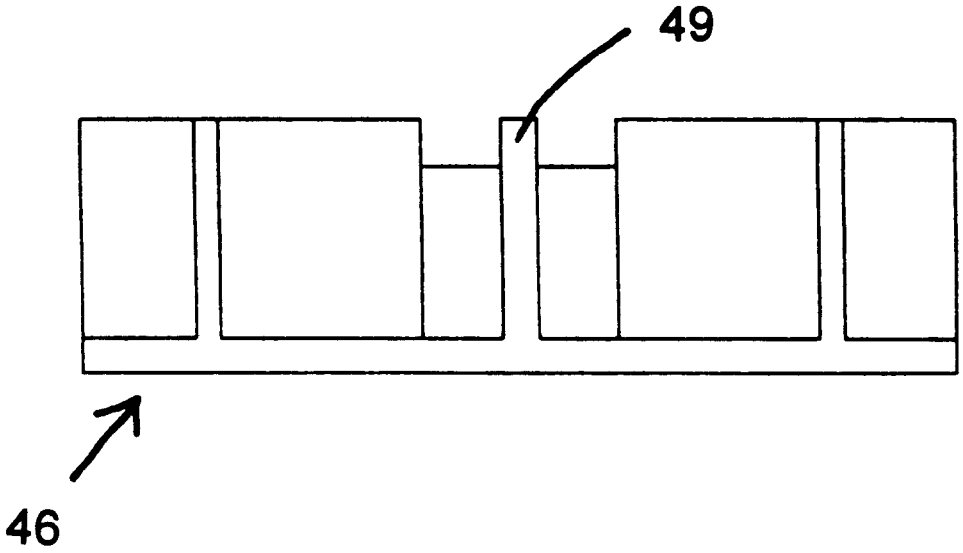

FIG. 20 shows an end view of the impeller.

Figure 21:
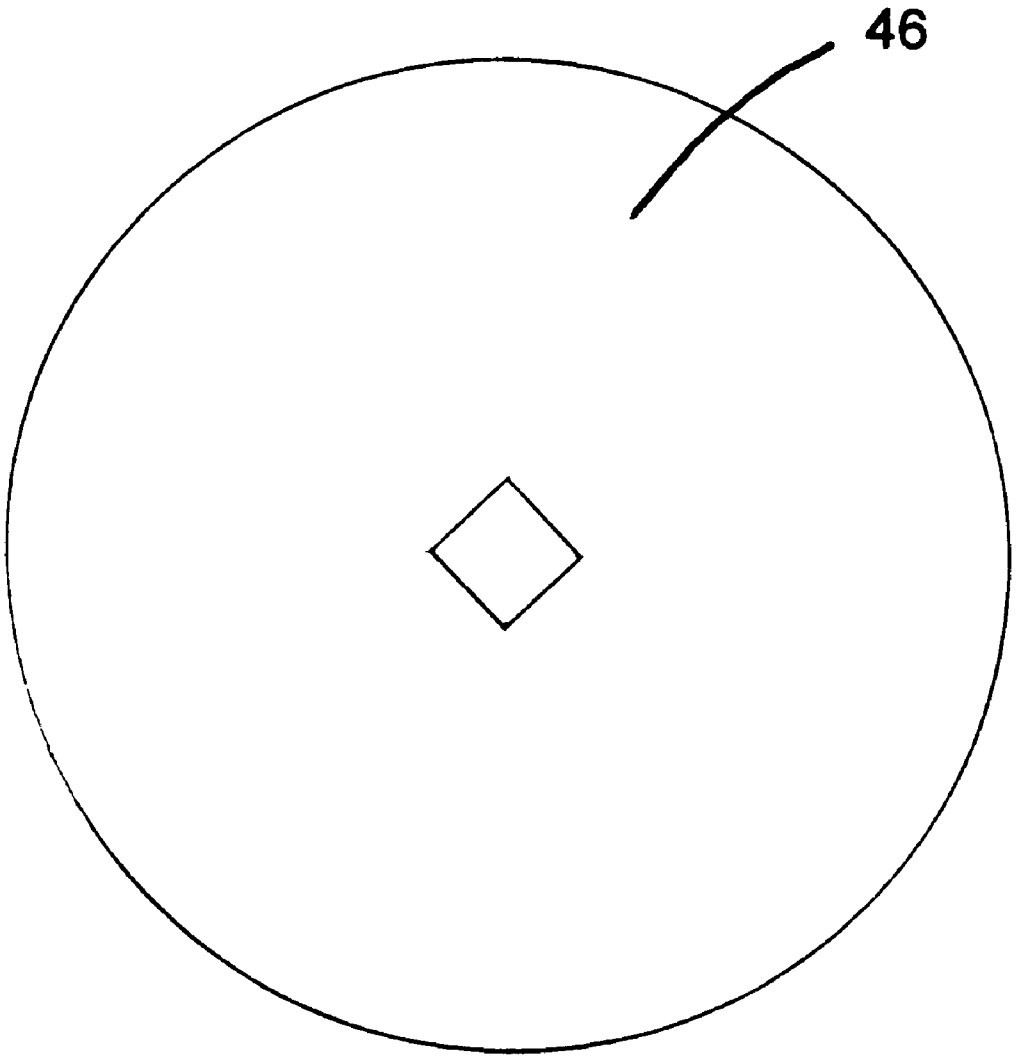

FIG. 21 shows a side view of the impeller (46), being the opposite side shown in FIG. 19, and not having impeller blades (49).

Figure 22:
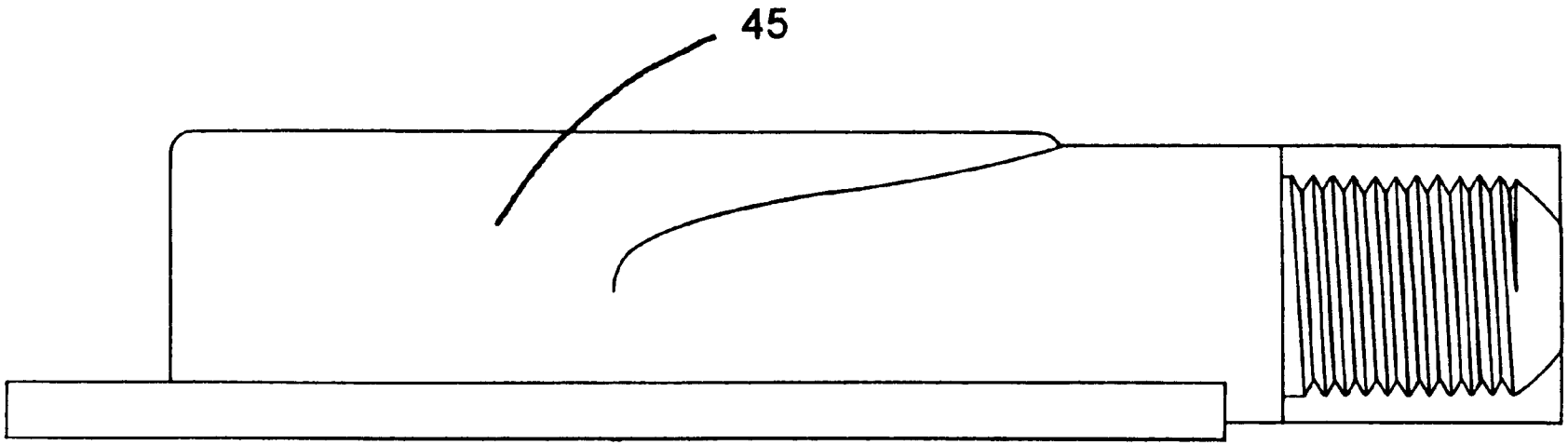

FIG. 22 shows a top end view of the impeller housing (45).

Figure 23:
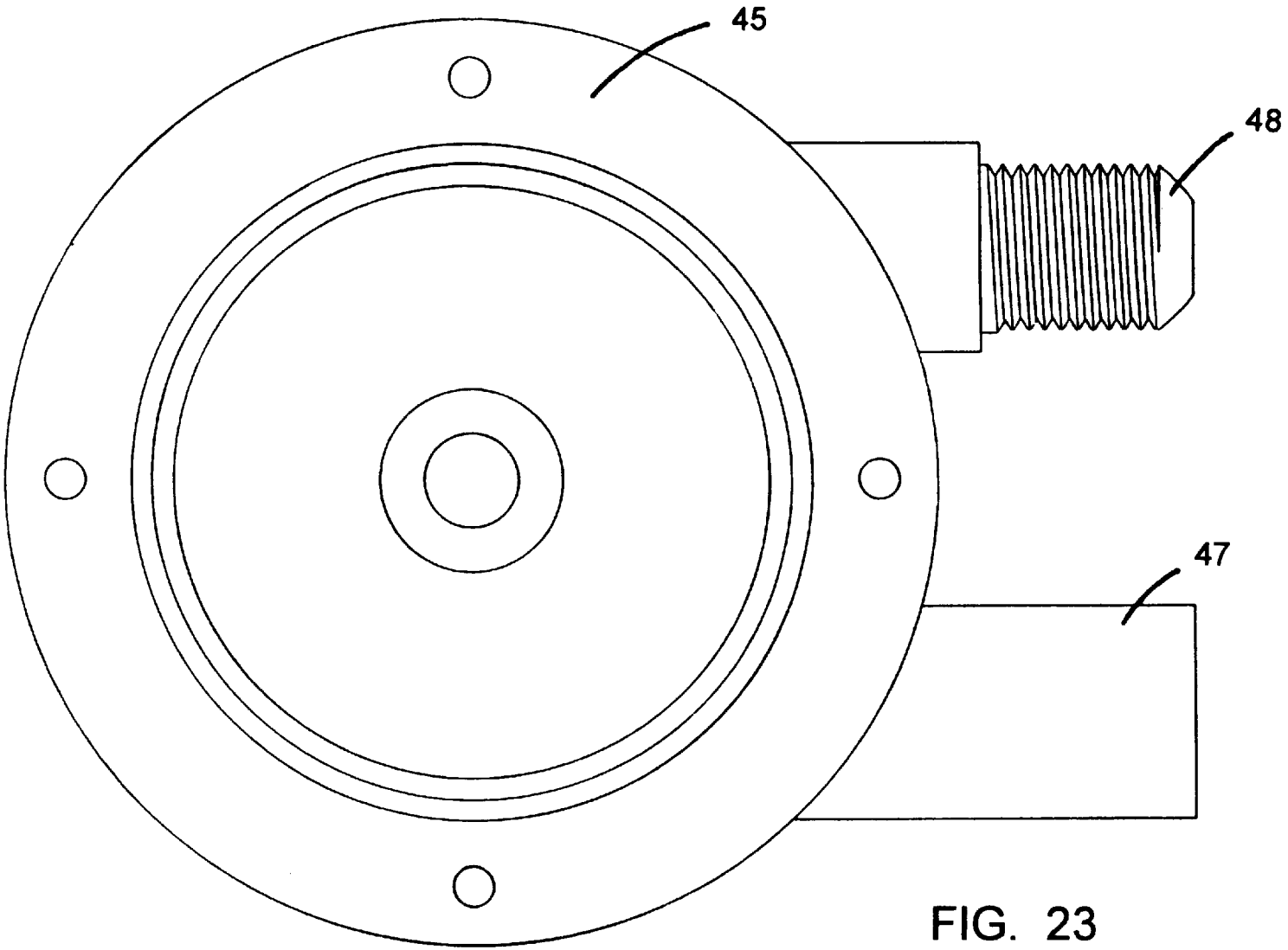

FIG. 23 shows a rear side view of the impeller housing (45).

Figure 24:
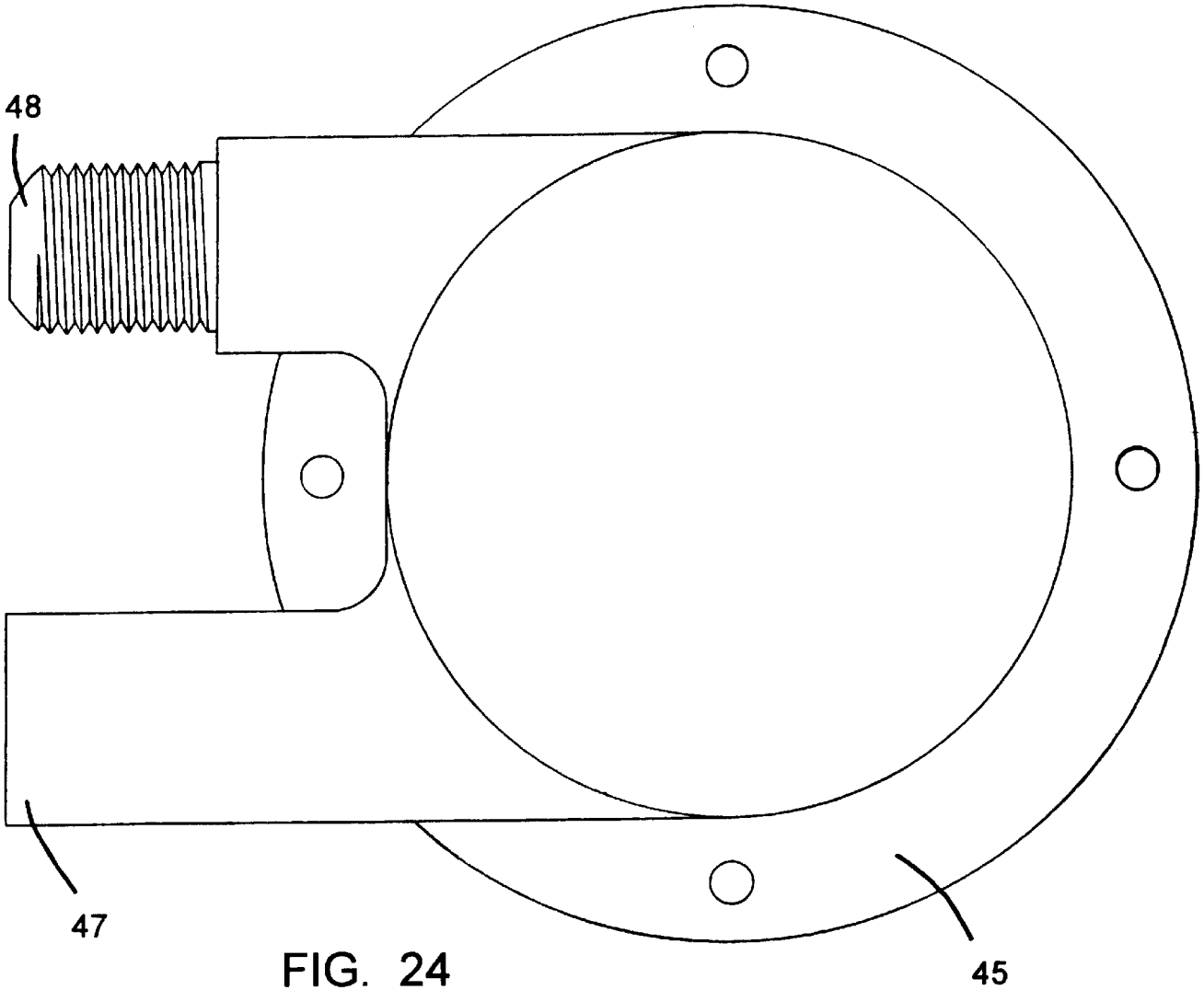

FIG. 24 shows a front side view of the impeller housing (45).

Figure 25:
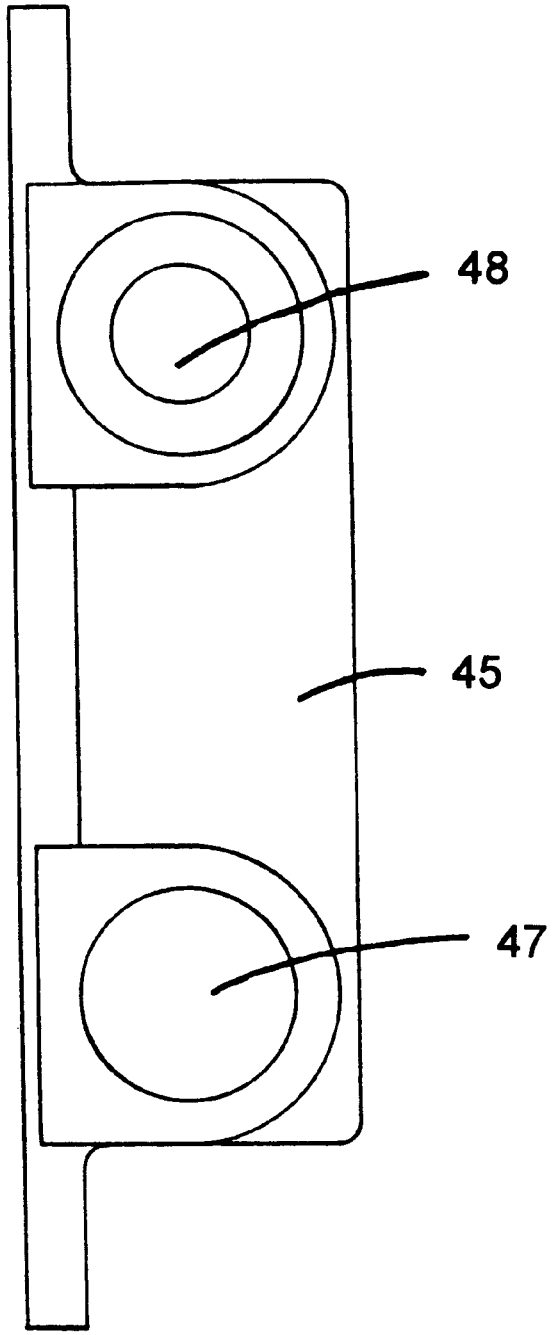

FIG. 25 shows an end view of the impeller housing (45), and being a view of FIG. 22 rotated 90-degrees in the counter-clockwise position, and thereby showing the water inlet port (47) and the water outlet port (48).

Figure 26:
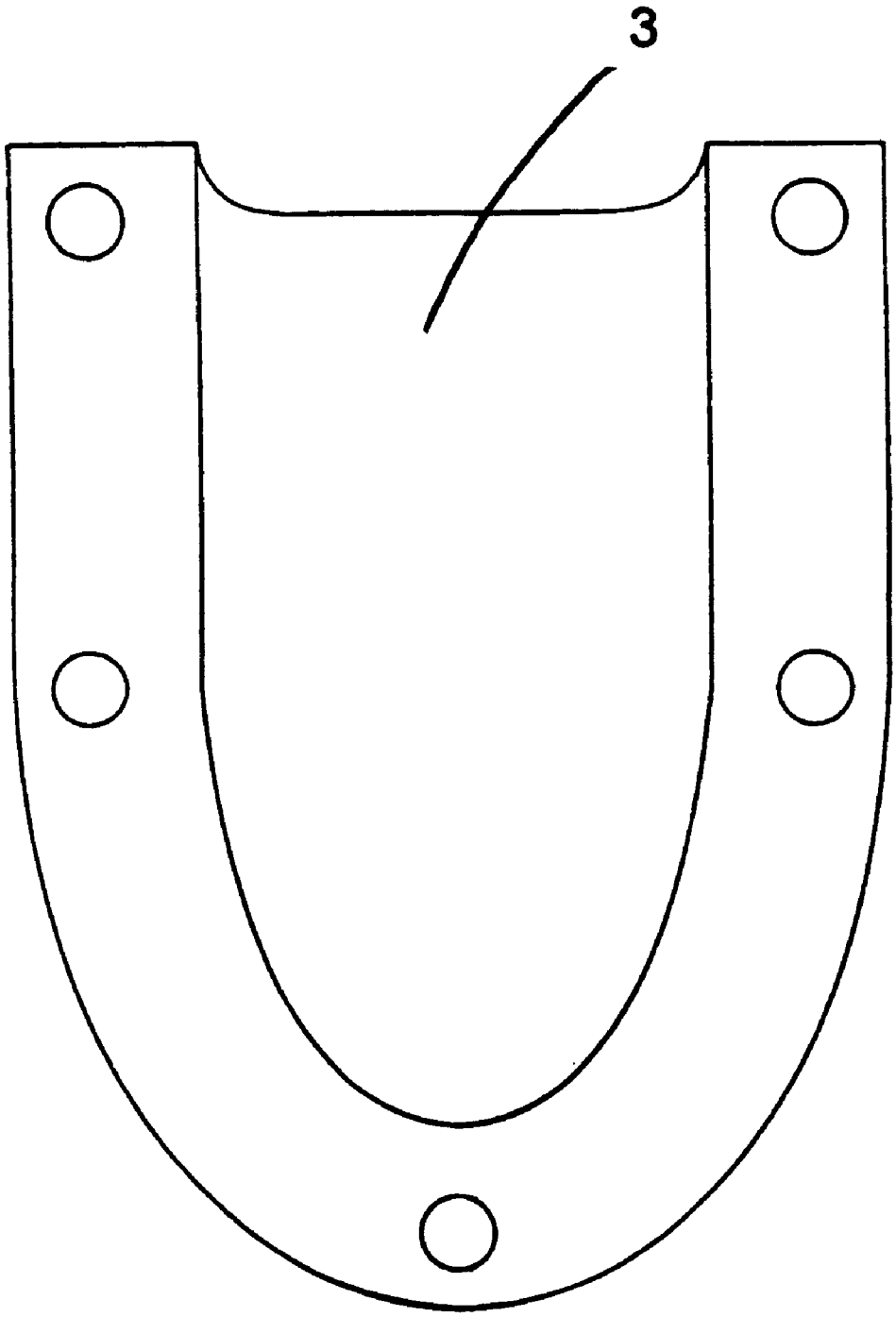

FIG. 26 shows a top view of the water catch device (3).

Figure 27:
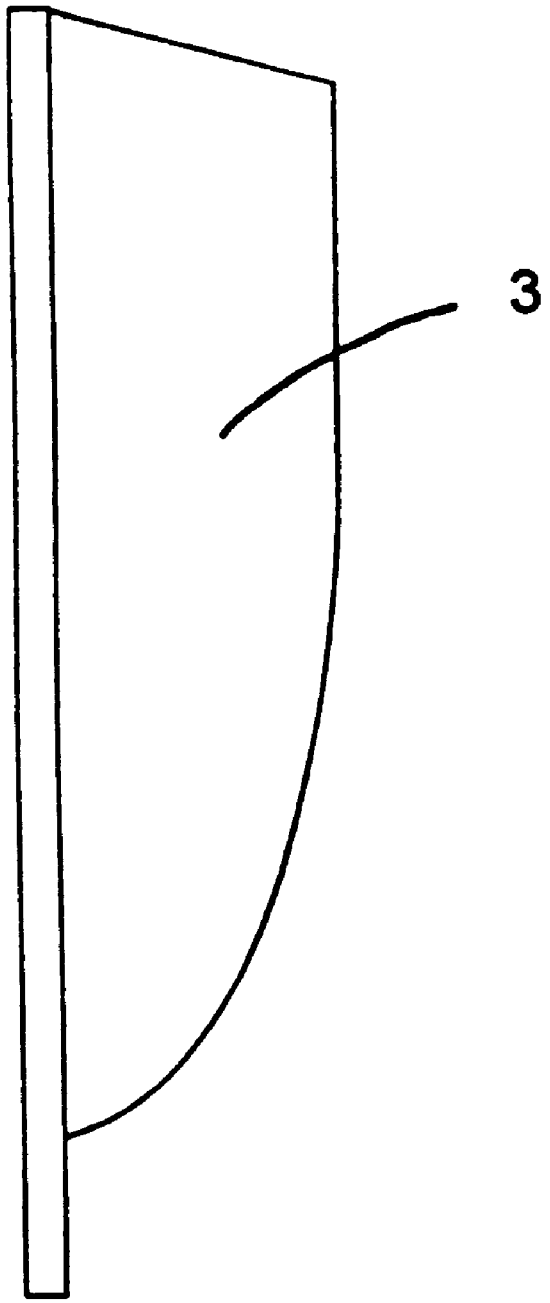

FIG. 27 shows a side view of the water catch device (3).

Figure 28:
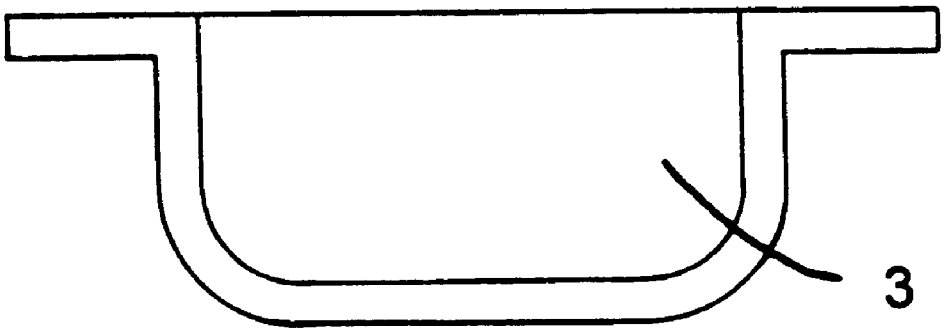

FIG. 28 shows a front view of the water catch device (3).

Figure 29:
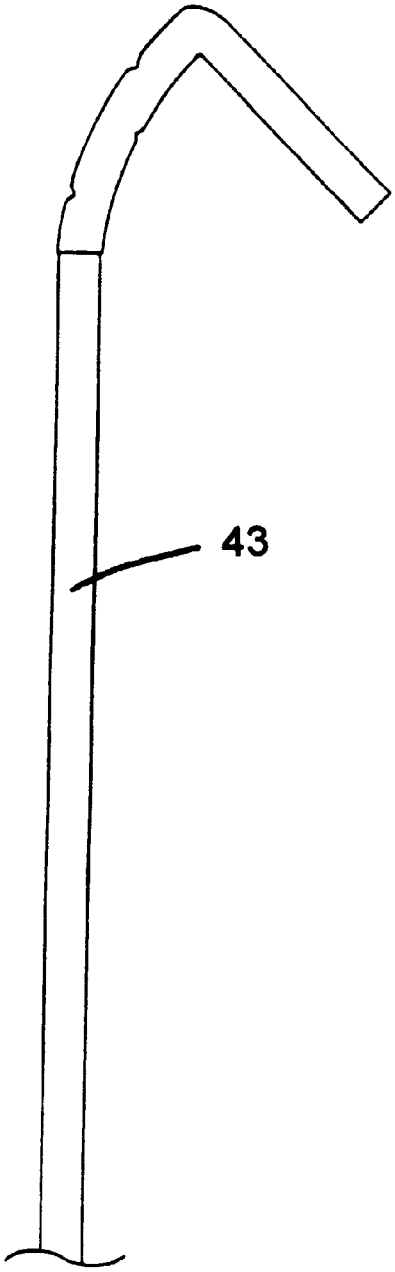

FIG. 29 shows a side view of the terminal end of the mast cable (43).

Figure 30:
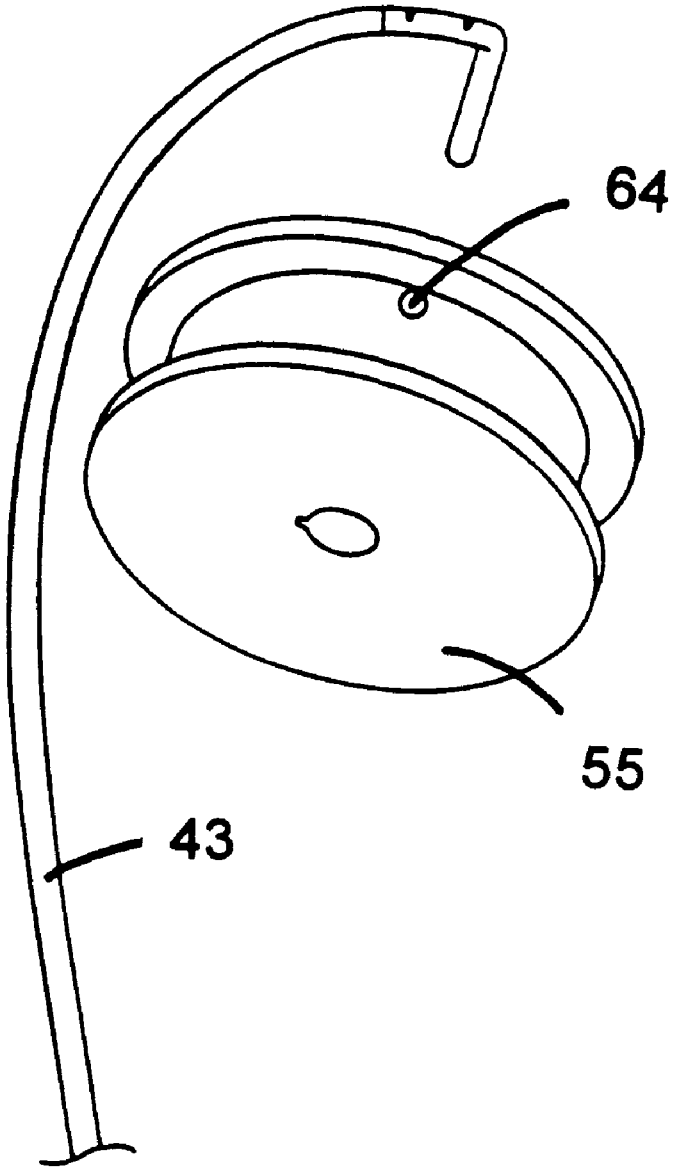

FIG. 30 shows the terminal end of the mast cable (43) and the spline pulley (55), with its mast cable orifice (64) for receiving said mast cable (43).

Figure 31:
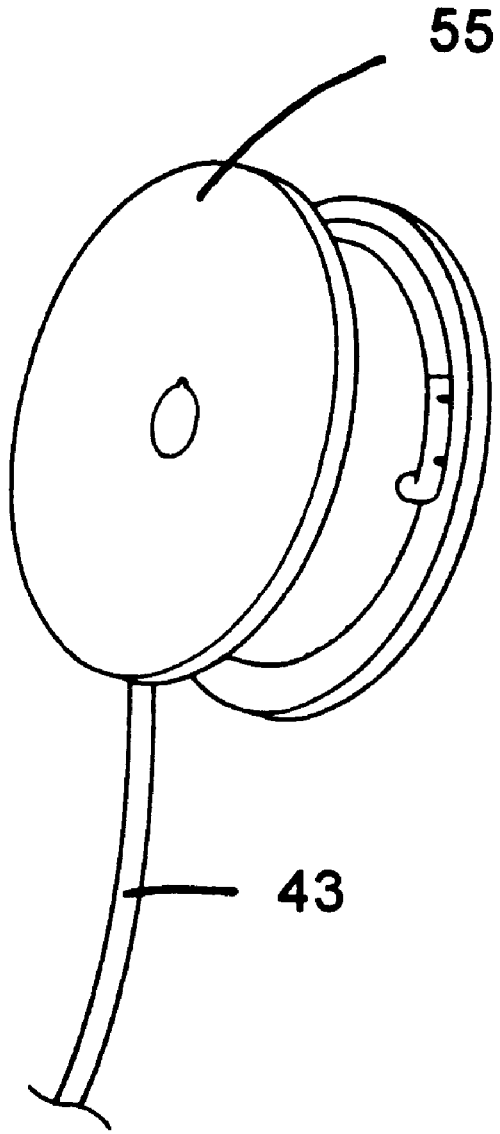

FIG. 31 shows the spline pulley (55) with the mast cable (43) connected thereto.

Figure 32:
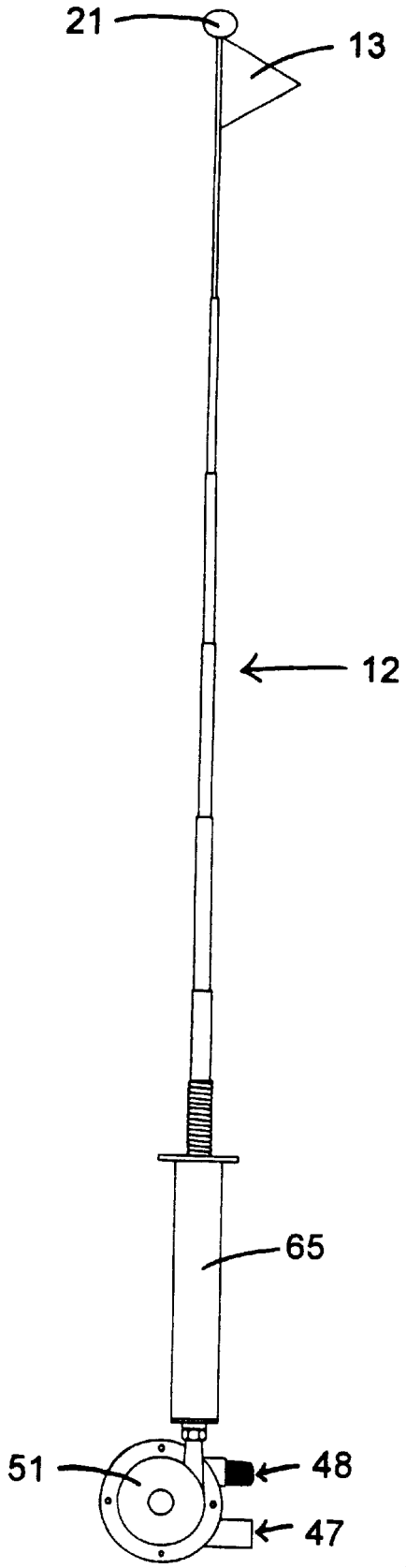

FIG. 32 shows the telescoping flag mast (12) in the extended position, with the mast assembly housing (65) for housing the telescoping segments of said flag mast (12), and the connected band spring housing assembly (51) of the fluid mechanical embodiment.

Figure 33:
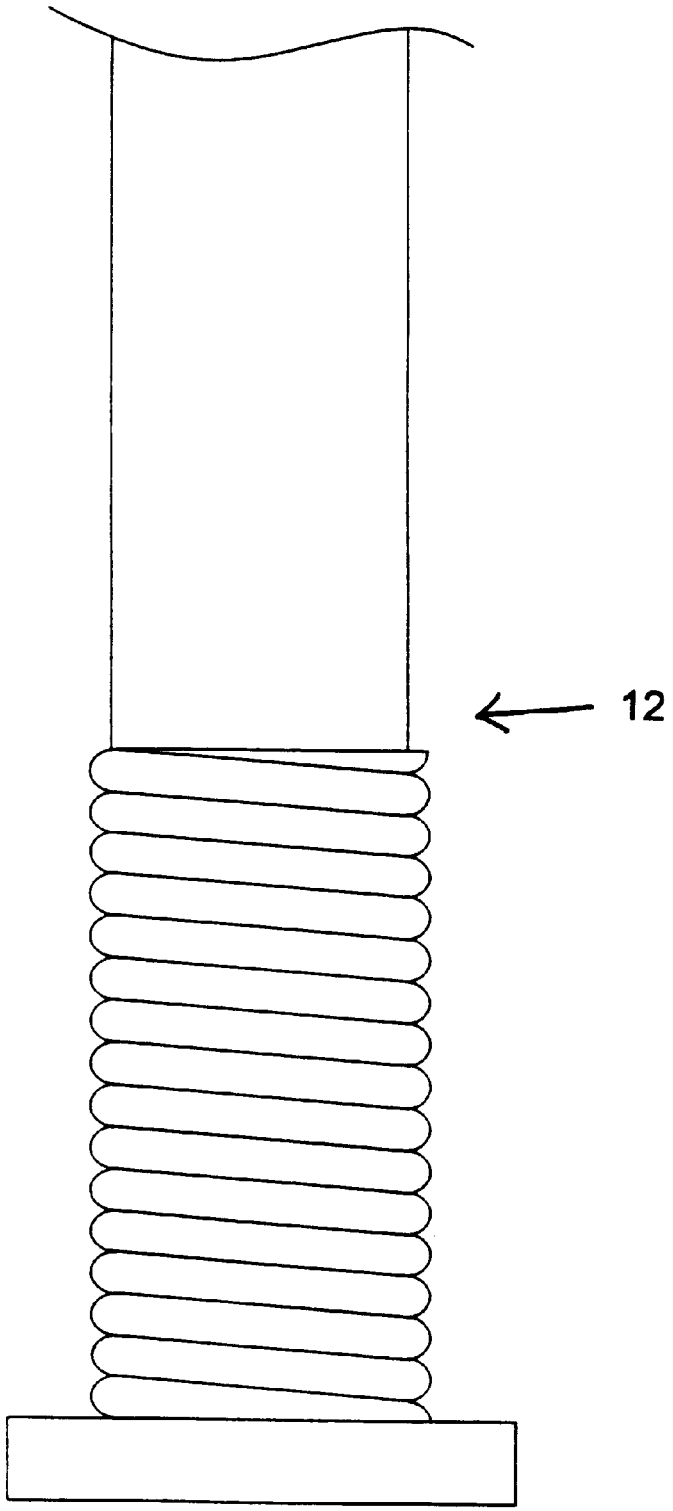

FIG. 33 shows the flexible or spring base of the telescoping flag mast (12).

Figure 34:
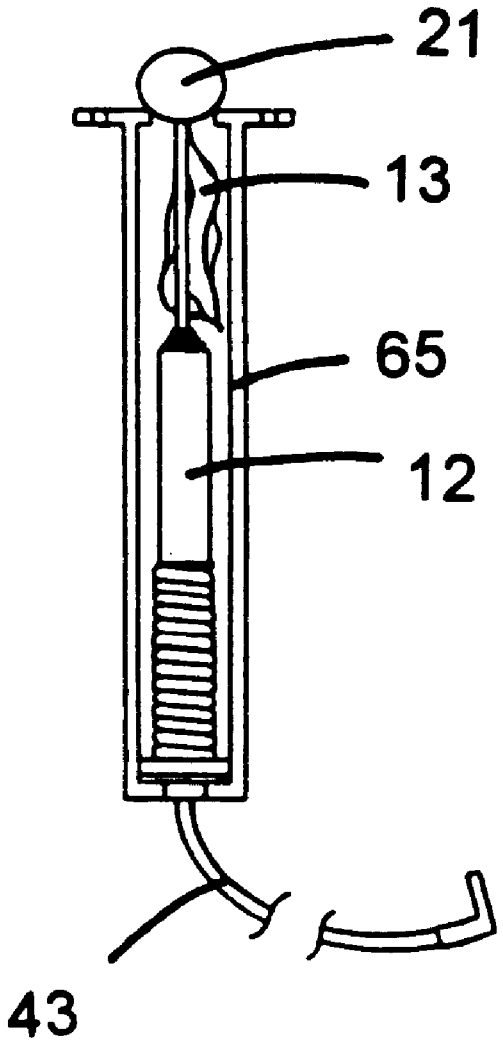

FIG. 34 shows a sectional side view of the flag mast assembly (34).

Figure 35:
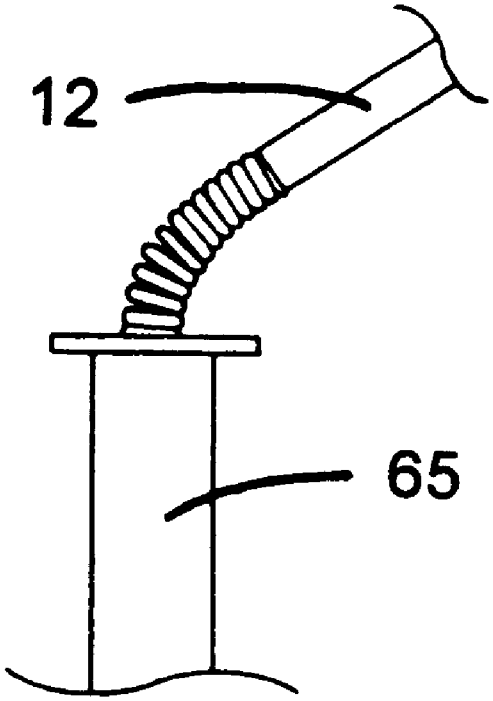

FIG. 35 shows the flexible or spring base of the flag mast (12) attached to the mast assembly housing (65), and said base of the mast (12) shown in a bent position.

Figure 36:
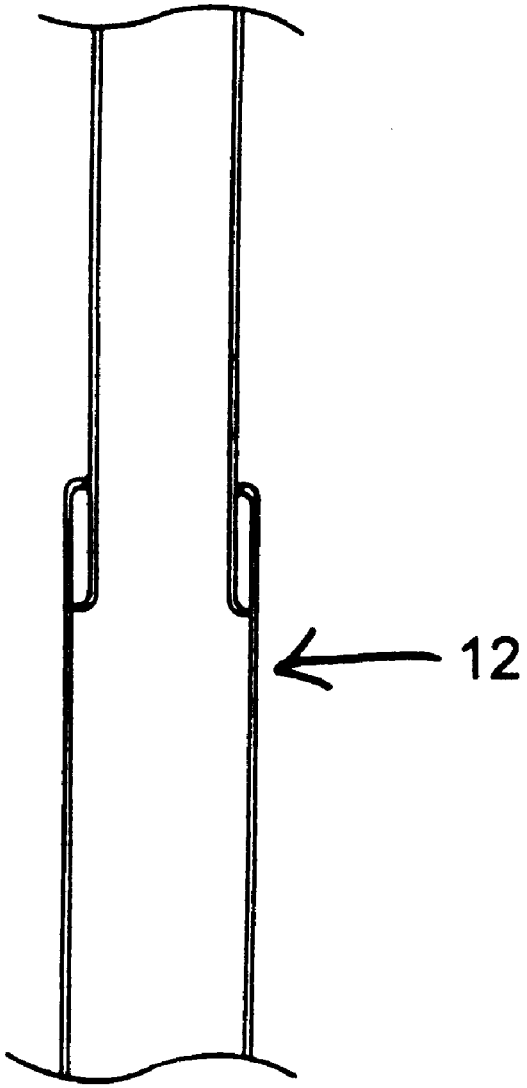

FIG. 36 shows a sectional side view of how the telescoping segments of the flag mast (12) are connected when said flag mast (12) is extended.

Figure 37:
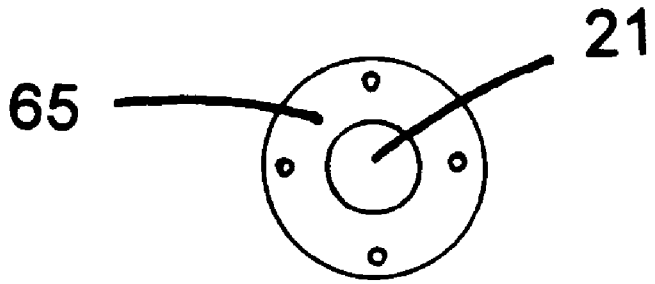

FIG. 37 shows a top view of the flag mast assembly (34), and showing the mast cover (21).

Figure 38:
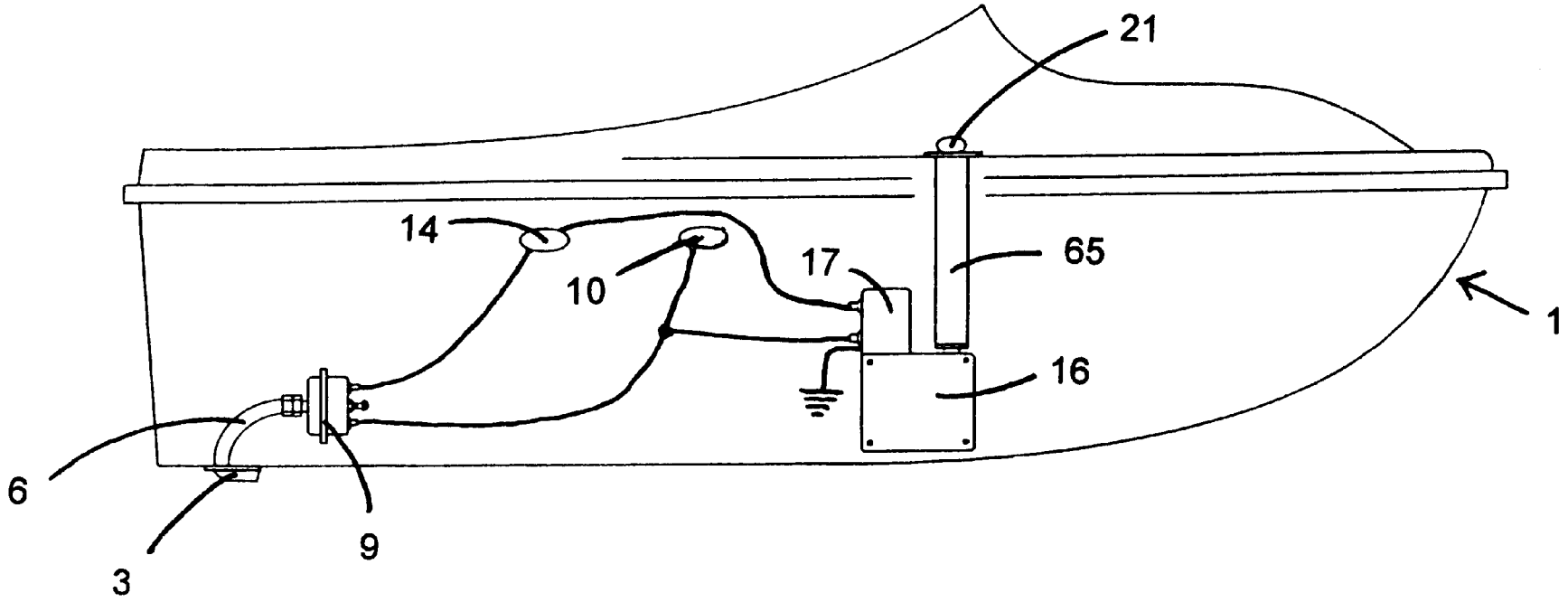

FIG. 38 shows a view of a plan view of a water vehicle (1) with the electromechanical embodiment of the Automatic Safety Flag device incorporated therein, and showing the flag mast (12) in the lowered position.

Figure 39:
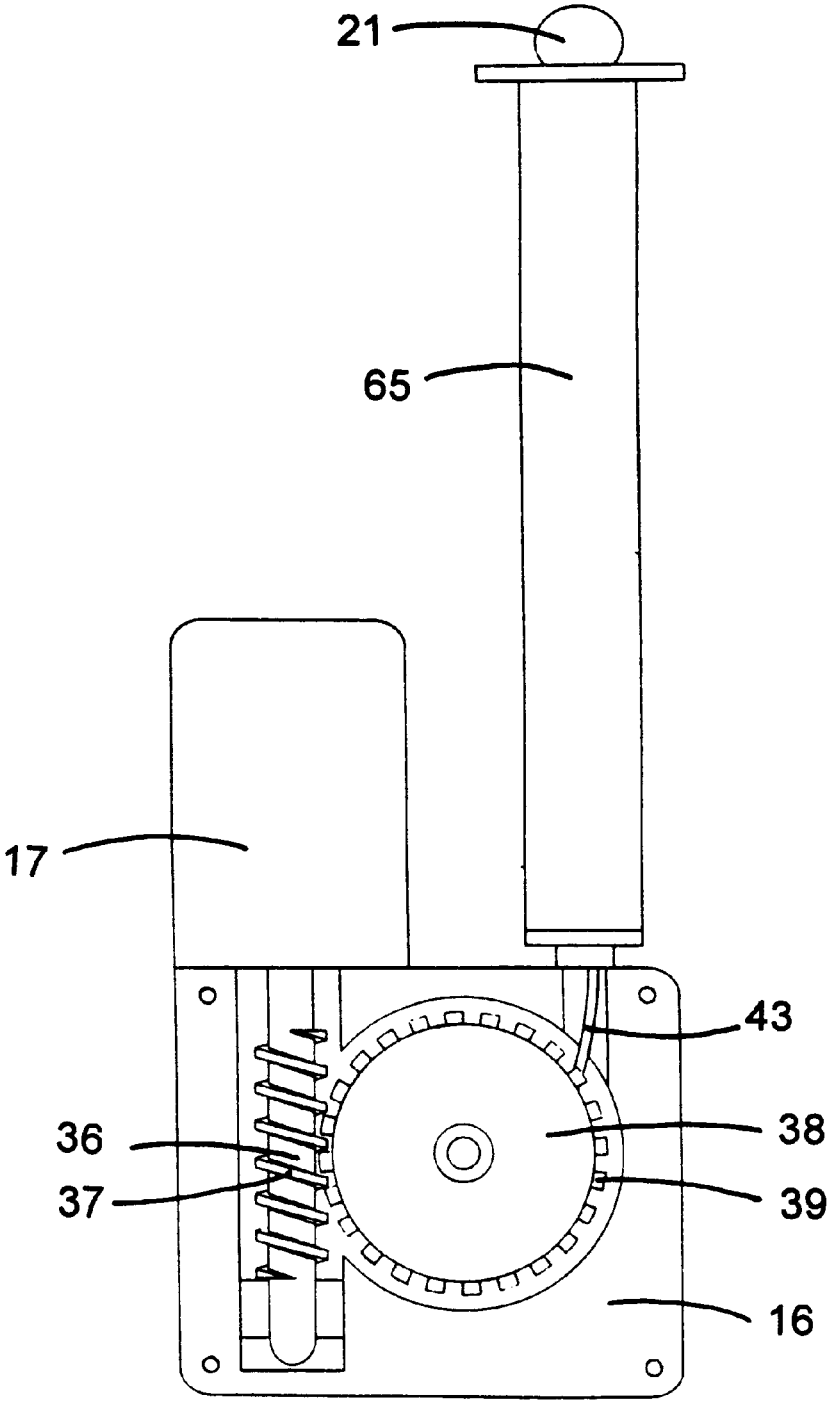

FIG. 39 shows a sectional side view of the motor assembly housing (16) in the electromechanical embodiment of the Automatic Safety Flag device, and including the motor assembly (15), worm gear (36), the circular gear (38), and with the connected mast assembly (34) shown.

Figure 40:
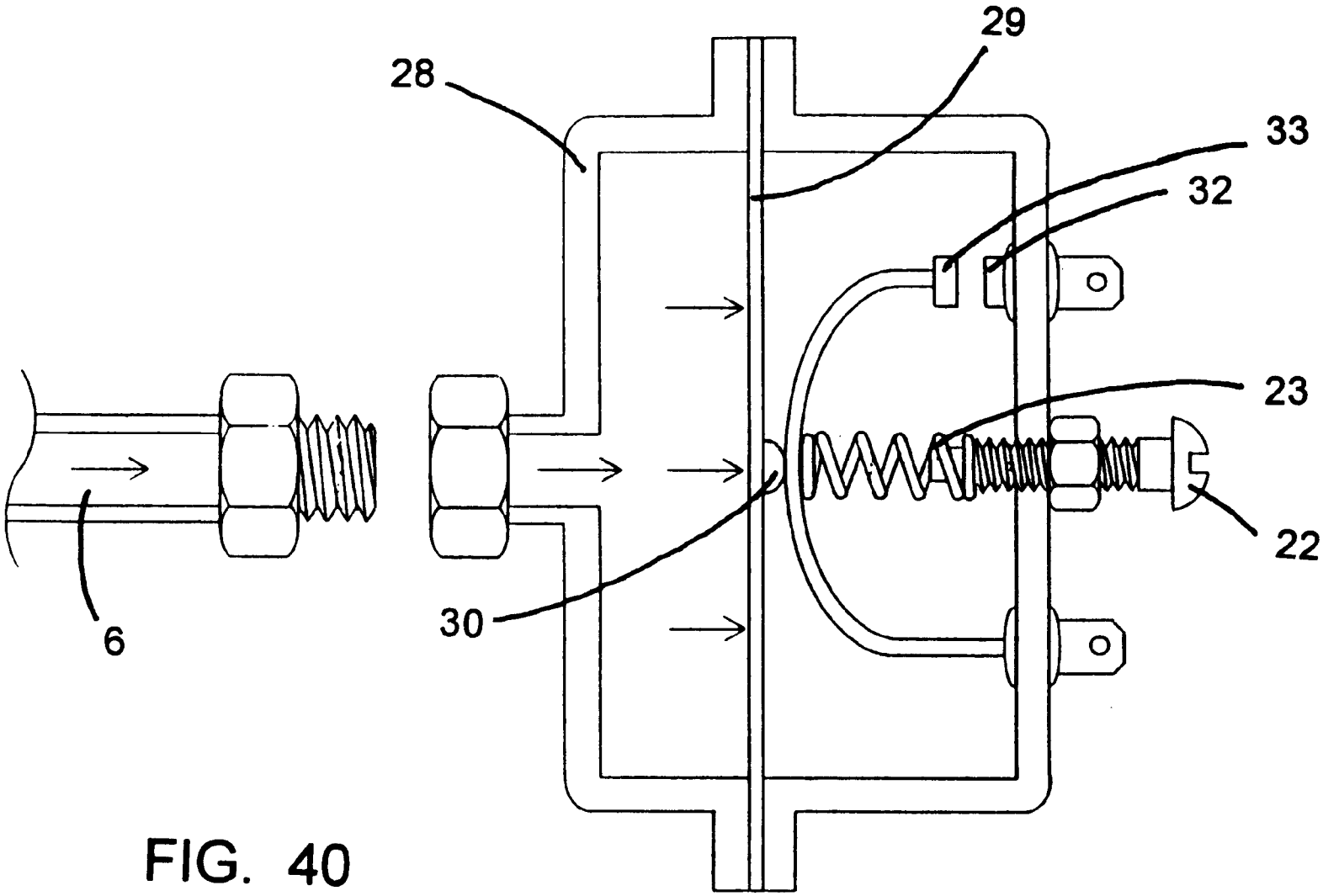

FIG. 40 shows sectional side view of the pressure switch (9) in the electromechanical embodiment of the Automatic Safety Flag device.

Figure 41:
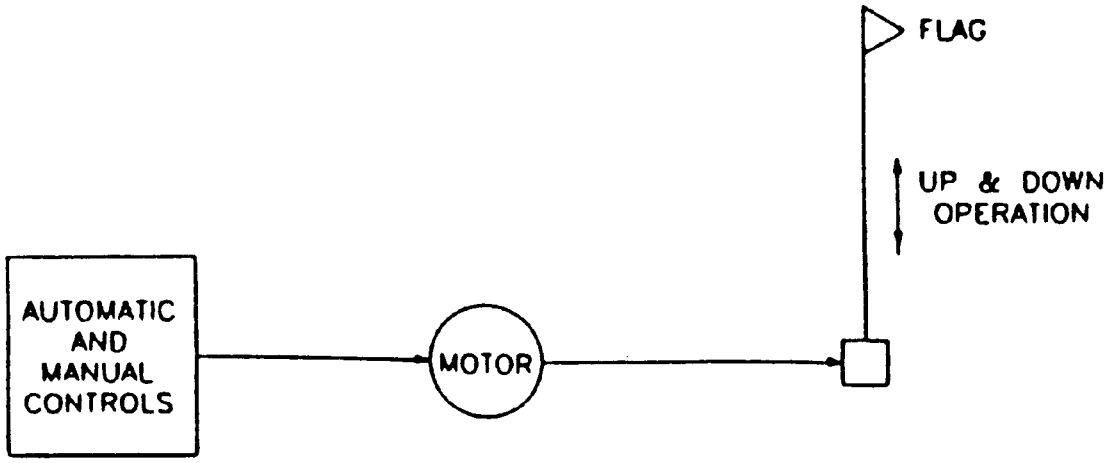

FIG. 41 shows an electrical concept diagram for a simple electromechanical embodiment of the Automatic Safety Flag device.

Figure 42:
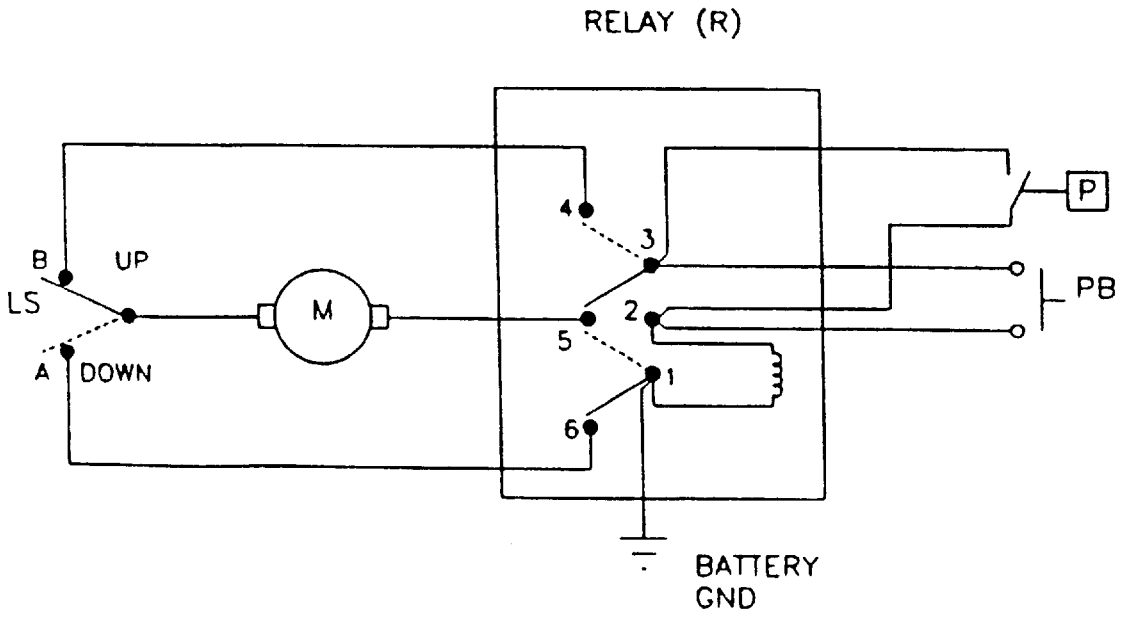

FIG. 42 shows an electrical wiring diagram for a simple electromechanical embodiment of the Automatic Safety Flag device in the de-energized state with the flag mast (12) down, and with the relay circuitry's (24) limit switch ("LS") on the telescoping flag mast (12) in position "A", and as shown in FIG. 42. With sufficient water pressure upon the pressure switch (9) ("P") or by pushing the mast lowering button (14) ("PB") the relay circuitry (24) will thereby energize the electric motor (17) for the flag mast (12), if said limit switch ("LS") is closed in position "B", with the flag mast (12) completely raised. When the flag mast (12) is retracted and hits the bottom position, the limit switch ("LS") will change from the "B" to the "A" position, with said flag mast (12) already in the lowered position. If the mast lowering button (14) ("PB") and the pressure switch (9) ("P") is opened, the flag mast (12) will go up because the relay circuitry (24) ("R") is de-energized and the normally closed ("NC") electrical contacts will power the electric motor (17) through the limit switch ("LS") in the "A" position, and until the flag mast (13) is completely extended and said limit switch ("LS") changes to the "B" position.

Figure 43:
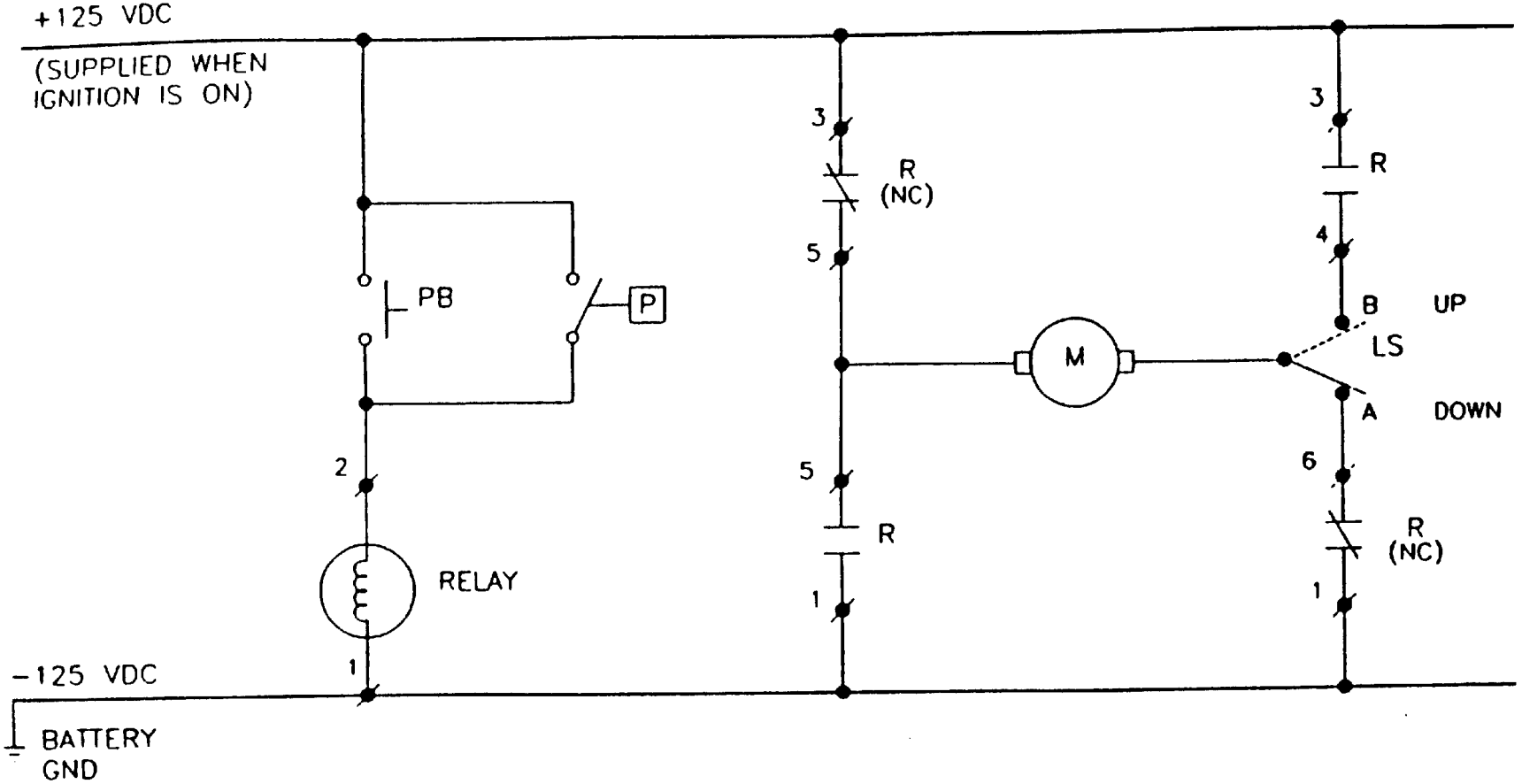

FIG. 43 shows a schematic diagram for a simple electromechanical embodiment of the Automatic Safety Flag device, such as that shown in the wiring diagram shown in FIG. 42, and in the de-energized state with the safety flag down, and the relay circuitry's (24) limit switch ("LS") in position "A".

These drawings represent examples of the inventors' various embodiments of the Automatic Safety Flag device, and should not be construed to be their only embodiments. Other embodiments may be devised, and are within the scope and claims of this invention.

REFERENCE NUMERALS IN THE DRAWING FIGURES

Referring now to the drawing figures, like reference numerals are used to refer to like specific parts of the various Figures, described above. The reference numerals used to describe the various parts of the Figures follows.

There are two sets of embodiments in the invention disclosed, i.e., an electromechanical embodiment and a fluid mechanical embodiment. For the convenience of the reader, the Applicant does herewith list the set of elements of said two embodiments in the two subset listings that follows. Some of the elements listed under the Electromechanical Embodiment are utilized in both the electromechanical, as well as the fluid mechanical embodiments of the Automatic Safety Flag, as noted below. If said elements are only utilized in the same embodiment under which it was listed, no further notation or statement as to the which embodiment employs said element is necessary.

The Electromechanical Embodiment

1. The Water Vehicle (1), is the vehicle, boat, ship, or watercraft, jet ski, wave runner, or other water recreational vehicles or the like, and as described above, in which the present invention may be incorporated. A water vehicle (1) may utilize either the electromechanical or the fluid mechanical embodiment of the present Automatic Safety Flag.

2. The Water (2), is the fluid which enters the water catch device (3) and activates the pressure switch (9) on the electromechanical embodiment, thereby raising or lowering the flag mast (12), depending on the water pressure, which is a function of the velocity of the water vehicle (1). In the fluid mechanical embodiment, described below, the water (2) drives the impeller (46), and whereby the pressure of the water (2) in the impeller (46), is a function of the velocity of the vehicle (1), and the pressure in said impeller (46) lowers the mast (12), when the vehicle (1) reaches a specified velocity.

3. The Water Catch Device (3), is the device protruding from the bottom or side of the water vehicle (1), and is optimally on or near the water vehicle's (1) propulsion or drive system (4) or the rear of the water vehicle's (1) hull. The water catch device (3) protrudes in such a way as to catch water (2) as the water vehicle (1) moves in a generally forward direction in the water (2). The greater the water vehicle's (1) velocity, the greater the water pressure entering the water catch device (3). The water catch device (3) is similar for the electromechanical and the fluid mechanical embodiments. In the electromechanical embodiment, the water catch device (3) directs water (2) to activate a pressure switch (9) which is attached to the terminal end of the water catch tube (6). In the fluid mechanical embodiment, the water catch device (3) directs water to the impeller housing (45), and where the pressurized water (2) there causes the impeller (46) to rotate; the water catch device (3) used in the fluid mechanical embodiment therefore is optimally larger, and directs the flow of more water (2), to affect the rotation of said impeller (46). The water catch device (3) may be mounted onto or through the water vehicle's (1) hull, or a mounting bracket or the like, which is attached to said hull, and mounted with screws, bolts and nuts, or a combination thereof, and gaskets or O-rings may be used to seal out the water from entering any mounting holes or orifices.

4. The Drive System (4), is the propulsion system for the water vehicle (1), which drives or powers said vehicle (1) through the water (2). This aspect of the water vehicle (1) is independent of the embodiment of the Automatic Safety Flag installed.

5. The Catch Port (5), is a part of the water catch device (3), and is the actual port, funnel, hole, orifice, slit, or the like, where water (2) enters the water catch device (3). As stated above, the catch port (5) is used on both the electromechanical and the fluid mechanical embodiments of the Automatic Safety Flag, with the fluid mechanical embodiment optimally employing a larger catch port (5).

6. The Water Catch Tube (6), is the tube, pipe, hose, conduit, or the like, where the water (2) travels through, after said water (2) enters the water catch device (3) through the catch port (5). The water catch tube (6) is connected on the output end to the catch port (5). The water catch tube (6) is used on both the electromechanical and the fluid mechanical embodiments of the Automatic Safety Flag, with the fluid mechanical embodiment optimally employing a larger water catch tube (6). The water catch tube (6) in the electromechanical embodiment of the Automatic Safety Flag device is connected or attached to the water catch device (3) on the input end, and to the pressure switch (9) on the opposite or terminal end of the water catch tube (6), with a connector or the like, which may be attached with a threaded screw fitting, a pressed fit connector, or a glue fitting, or a combination thereof, and which is utilized for attaching said tube (6) to the pressure switch (9).

7. The Tube Terminal End (7), is the output end of the water catch tube (6), described above. In the electromechanical embodiment of the Automatic Safety Flag, the tube terminal end (7) is connected to the pressure switch (9). In the fluid mechanical embodiment of the Automatic Safety Flag, the tube terminal end (7) is connected to the water inlet port (47) to the impeller housing (45), thereby driving the impeller (46) contained within said housing (45).

8. The Vehicle Engine (8), is the means of propulsion for the water vehicle (1), and is typically located at the rear of said vehicle (1). The vehicle engine is independent of the Automatic Safety Flag.

9. The Pressure Switch (9), is the pressure activated switch (9) utilized in the electromechanical embodiment of the Automatic Safety Flag, that will turn on the electric motor (17), to either raise or lower the flag mast (12).

10. The Ignition Switch (10), is the switch (10) which may turn the vehicle's ignition system (11) on or off, and is typically activated or inactivated by the turning of a key or the like. The ignition switch (10) is independent of the embodiment utilized in the Automatic Safety Flag.

11. The Ignition System (11), is the electrical system which supplys electrical power to start and run the vehicle's engine (8). The ignition system (11) is independent of the embodiment utilized in the Automatic Safety Flag.

12. The Flag Mast (12), is the mast or pole (12), which may or may not be telescoping, but in a preferred embodiment is telescoping, and which in some preferred telescoping embodiments, may be in three or four sections. When the flag mast (12) is fully extended, the telescoping sections firmly connect or lock to their neighboring sections, thereby forming an erect, and optionally flexible, flag mast (12). Each section of the telescoping flag mast (12) is matedly interlocked or attached to its neighboring section with the mast cable (43) running lengthwise through said sections. Each section has an outward flared bottom, or the like, which matedly fits or attaches with the inward flared top, or the like, of its attached neighboring section, and with the top section of the telescoping flag mast (12) not requiring an inward flare, or the like, at its top, and the bottom section of the telescoping flag mast (12) not requiring an outward flare, or the like, at its bottom. The safety flag (13) is typically attached near the terminal end of said flag mast (12). In some simple embodiments of the Automatic Safety Flag, a one-piece body, non-telescoping flag mast (12) may be used, and with the mast cable (43) running through the length of said mast (12). A similar flag mast (12) may be utilized in the electromechanical and the fluid mechanical embodiments of the Automatic Safety Flag.

13. The Safety Flag (13), is the flag, banner, pennant, or the like, which is typically attached near the terminal end of the flag mast (12), such that when said mast (12) is raised, the safety flag (13) is visible and observable near the terminal end of said mast (12). In some embodiments of the Automatic Safety Flag, a light or a combination safety flag and light may be attached near the terminal end of the flag mast (12). The term "safety flag" is thereby also intended to be interpreted as meaning one or more safety lights or a combination safety flag and safety light or lights. A similar safety flag (13) or the like, may be utilized in the electromechanical and fluid mechanical embodiments of the Automatic Safety Flag.

14. The Mast Lowering Button (14), is the momentary open switch, button, lever, or the like, which may be activated by the operator of the water vehicle (1), to momentarily energizes the electric motor to lower the flag mast (12), when said vehicle (1) is not in operation or is being transported.

15. The Motor Assembly (15), is the set of elements, typically arranged as a unit, and which typically includes the motor (17), the worm gear (36), the circular gear (38) and counting device (42), and mast cable (43) for the flag mast (12). There are variations in the embodiment for the motor assembly, which may include additions, deletions, substitutions, or hybrids to the above described elements.

16. The Motor Assembly Housing (16), is the housing, case, or the like, which contains the elements or pieces for the motor assembly (15).

17. The Electric Motor (17), is the machine used to transform electrical power into mechanical power, which is then used to power the electromechanical embodiment of the Automatic Safety Flag.

18. The Battery (18), is the electrical power source for the ignition system (10). A power generator may also provide the electrical power in some embodiments of the invention, and is intended to be included under the term, "battery" (18). The battery (18) is utilized in powering only the electromechanical embodiment of the Automatic Safety Flag, although a battery (18) is generally utilized in water vehicles (1) utilizing either embodiment of the Automatic Safety Flag.

19. The Electrical Ground (19), is the electrical connection from the negative pole on the battery (18) to the motor (17) or to a metallic bracket or the like, which affects an electrical ground path (19).

20. The Mast Opening (20), is the opening or the like, typically on the top surface of the vehicle (1), whereby the flag mast (12) is stored when not in use or is lowered, and whereby said mast (12) extends out of, when it is activated to the raised position.

21. The Mast Cover (21), is the cover or the like to the mast opening (20), and protects said opening (20) from foreign objects and water. The mast cover (21) is an optional element to the present invention in some embodiments, but may be needed in many embodiments, to prevent water (1) from entering the mast opening (20) and thereby entering the vehicle's (1) hull.

22. The Adjusting Screw (22), is the adjusting screw, knob, or the like to regulate, adjust, or control the sensitivity of the pressure switch (9).

23. The Spring (23), is the device or element which provides mechanical pressure to the adjusting screw (22) on the pressure switch (9) to prevent the screw (22) from loosing its setting or adjustment.

24. The Relay Circuitry (24), is the electrical path or circuit providing an electrical or communication channel or path between two or more electrical or electronic components in the present Automatic Safety Flag.

25. The Electrical Terminal (25), is the terminal (25) where the electrical wires or wiring terminates or is connected on each said wire's terminal end.

26. The Electrical Connector (26), is the clip, plug, jack, socket, lug, binding post, connector screw, or the like, or a combination thereof, which is used to make an electrical connection.

27. The Vehicle Control Panel (27), is the dash board, panel, or the like, where the water vehicle's (1) controls, switches, instruments, and displays are typically located.

28. The Pressure Switch Housing (28), is the housing or the like which actually encases or encloses the pressure switch (9).

29. The Diaphram (29), is an element in the pressure switch (9), where the water pressure pushes through one side, i.e., the input side of the water catch tube (6), and is prevented by said diaphram (29) from entering the opposite side, the output side, which contains electrical connectors (26) and circuitry.

30. The Protruding Diaphram Notch (30), is the notch (30) attached or affixed to the diaphram (29), and on the output side of said diaphram (29). When pressure, i.e., water pressure, is applied to the diaphram (29) on the input side, the protruding diaphram notch (30) on the output side of said diaphram (29), further protrudes and provides the means for closing the diaphram electrical contact (31).

31. The Diaphram Electrical Contact (31), is the electrical contact or the like which makes contact with the protruding diaphram notch (30) when sufficient water pressure is applied.

32. The Open End of Pressure Switch (32), is the one terminal contact which remains open at all times, until sufficient pressure on the diaphram (29) forces the switch (32) to close, which completes that portion of the electrical circuit.

33. The Closed End of Pressure Switch (33), is the electrical terminal which is in electrical communication with the one terminal contact on the diaphram (29), when there is sufficient water pressure on the diaphram (29) to force the switch (32) to close, and which thereby completes that portion of the electrical circuit. When there is insufficient water pressure on said diaphram (29), the closed end of the pressure switch (33) remains open.

34. The Mast Assembly (34), is the telescoping set of connected shafts, rods, poles, or the like, which essentially comprise the flag mast (12), and which mechanically or electromechanically extend or retract said telescoping set of connected flag mast (12) elements, in a telescoping manner, to raise or lower the safety flag (13), which is located at or near the top or terminal end of the flag mast (12).

35. The Shaft (35), is the tubular or cylindrically shaped element which leads from the electric motor (17), and which rotates about the central axis of its cylindrical or tubular shape.

36. The Worm Gear (36), is the element of the Automatic Safety Flag, which is attached to the end of the shaft (35), and which is opposite that of the end of the shaft (35) which is attached to the motor (17).

37. The Worm Gear Teeth (37), are the teeth or the like, which are protruding from around the perimeter of the worm gear (36), such that said teeth (37) are protruding along the same axis as said gear (36), and in an outward direction from the shaft (35), to matedly receive the circular gear teeth (39), on the circular gear (38).

38. The Circular Gear (38), is the element of the Automatic Safety Flag, which is set in a motion, by the rotation of the connected worm gear (36), and which causes said circular gear (38) to rotate in a clockwise or a counter-clockwise direction, depending upon the rotation direction of the worm gear (36). The circular gear (38) will thereby either pull the mast cable (43) up or down, respectively, thereby raising or lowering the flag mast (12). In some equivalent embodiments of the present invention, the rotation of the circular gear (38) in a clockwise direction may pull the mast cable (43) down, rather than up; and the rotation in the opposite, counter-clockwise, direction, would pull said cable (43) up.

39. The Circular Gear Teeth (39), are the teeth or the like, which are protruding from around the perimeter of the circular gear (38), such that said teeth (39) are protruding along the same axis as said gear (38), and in an outward direction to matedly receive the worm gear teeth (37) of the worm gear (36).

40. The Spool (40), is the element of the Automatic Safety Flag, which is attached to or a part of the circular gear (38), and which the mast cable (43) winds around or unwinds around.

41. The Cam (41), is the notch, bump, rib, or ridge, or the like, located on the circular gear (38), and which makes mechanical contact with the counting device (42). In preferred embodiments of the Automatic Safety Flag, the counting device (42) may be stationary on the motor assembly housing (16), which also houses the circular gear (38) and the worm gear (36), in mast cable (43) may be similarly comprised on both the electromechanical and the fluid mechanical embodiments of the Automatic Safety Flag.

44. The Reversed Polarity Ground (44), is the electrical ground and its electrical connection, and which functions as a ground when the polarity is reversed through the electrical relay circuitry (24).

The Fluid Mechanical Embodiment

Some elements of the fluid mechanical embodiment of the Automatic Safety Flag are the same or essentially the same as are used in the electromechanical embodiment, whose elements are described above. The fluid mechanical embodiment generally has fewer essential elements than the electromechanical embodiment described above. When the fluid mechanical embodiment's elements are essentially the same as those used in said electromechanical embodiment, the same reference numeral used for the electromechanical embodiment, will also be used for the fluid mechanical embodiment. The additional elements generally found exclusively in the fluid mechanical embodiment follow.

45. The Impeller Housing (45), is the housing which contains the impeller (46). In a preferred embodiment of the impeller housing (45), it is comprised essentially of two pieces, with the first piece containing said impeller (46) and the second piece being the cover or the like, which covers a portion of the impeller (46) and seals it into the impeller housing (45). As a part of the impeller housing (45) or its cover, as described above, there is an water input port (47), leading to the impeller blades (49), and a water output port (48), leaving the vicinity of said blades. The impeller housing (45) is optimally composed essentially of a polymeric material, such as plastic, but may be composed essentially of other materials, such as stainless steel, brass, fiberglass, or composite materials.

46. The Impeller (46), is the device comprised essentially of the set of impeller blades (49) and the protruding gear (50), which both move about the central axis of a axle, thereby rotating said protruding gear (50), as the impeller blades (49) rotate. In preferred embodiments of the Automatic Safety Flag, the protruding gear (50) is near one end of said axle, and is manufactured as a single and attached part. The part of the protruding gear (50) which protrudes is splined, geared, or notched for a keyway, or a combination thereof.

47. The Water Inlet Port (47), is the port, channel, tube, or funnel, in which water (2) is directed into the impeller housing (45), thereby causing the impeller blades (49) to rotate. At a wakeless velocity, some water (2) may continue to enter the water inlet port (47), but may be of insufficient pressure to cause the impellor blades (49) to rotate.

48. The Water Outlet Port (48), is the port, channel, or tube, in which water (2) is directed from the impeller housing (45), after causing the impeller blades (49) to rotate. At a wakeless velocity, some water (2) may continue to flow through the water inlet port (47), and through the fluidically connected water outlet port (48), without causing the impeller blades (49) to rotate, due to insufficient water pressure.

49. The Impeller Blade (49), is the blade, fin, or the like, which is affixed or mounted about a generally central axis, and a plurality of impeller blades (49) may move or spin about a central axis, when a force is applied in a direction tangental to said central axis. The impeller blade (49) may optionally be flat or concave, or spoon-shaped. When the blades (49) rotate about the centrally located protruding gear (50), said gear (50) rotates accordingly.

50. The Protruding Gear (50), is the terminal end of the centrally located shaft, which is the central axis for the impeller (46), and said terminal end contains splines, gears, or is notched for a keyway, or a combination thereof. The protruding gear (50) is inserted into a spool (55). As the centrally located shaft with the geared terminal end rotates, the gear (50) inserted into said spool (55), causes the spool (55) to thereby rotate accordingly.

51. The Band Spring Housing Assembly (51), is the optional housing or cover which may enclose the band spring (52) and its associated uncovered or unhoused parts.

52. The Band Spring (52), is the spring or the like, which is attached on one terminal end to the protruding gear (50), and on the other terminal end to the impeller housing (45) by means of a pin, bolt, screw, dowel, or the like.

53. The First Band Spring End (53), is the terminal end is the band spring (52), which optimally would slip into the protruding gear's (50) central shaft, and be affixed or attached thereto.

54. The Second Band Spring End (54), is the terminal end of the band spring (52), which is optimally held stationary or in-place, to the impeller housing (45), with a pin, bolt, screw, dowel, or the like, and which holds the band spring (52) and prevents said band spring (52) from becoming dislodged or malaligned, while mechanical energy is accumulating and being stored within the band spring (52), due to the rotation of the impeller (46) and its associated shaft and protruding gear (50).

55. The Spline Pulley (55), is the female internally splined, geared or notched recepticle to matedly receive the male protruding gear (50). When said protruding gear (50) rotates, the spline pulley (55) thereby rotates and winds up or down a mast cable (43), accordingly. One end of the spline pulley (55) may optionally be recessed or cupped enough to allow the spline pulley (55) to cover the band spring (52) assembly.

DESCRIPTION OF THE PRESENT INVENTION

In trying to solve these boating and water recreational vehicle disadvantages and problems, and within the scope of this objective, it was surprising to find that a solution to the above described disadvantages and problems need not be expensive or involve complex technology.

A water catch device (3) is optimally located on the bottom of the water vehicle (1) and toward the rear end of said vehicle (1), and near the drive system (4). This water catch device (3) will catch water (2) through the catch port (5) and direct said water (2) into an attached water catch tube (6), which at said tube's (6) other terminal end, thereby leads to a pressure switch in the electromechanical embodiment, and leads to an impeller housing in the fluid mechanical embodiment. Said water catch device (3) may be, but is not necessarily similar to the type of speedometers typically used on outboard motor boats.

The Electromechanical Embodiment

In the electromechanical embodiment of the Automatic Safety Flag, the water catch tube (6) which optimally enters the rear of the vehicle (1) is connected to a pressure sensitive mechanical switch (9), which is optimally located inboard in or near the engine (8) area. The pressure switch (9) is wired into the ignition system (10). Once the water vehicle operator turns on the ignition (10), to start the engine (8), the flag mast (12) will extend. As the water vehicle (1) is operating at a slow or wakeless speed, the flag mast (12) will remain extended. Once the water vehicle (1) speeds up, and is traveling at a velocity greater than approximately 5 miles per hour ("MPH") or a wakeless velocity, the pressure switch (9) will be activated, due to a change in water pressure through the water catch device (3), and retract the flag mast (12). The flag mast (12) will remain retracted until the water vehicle (1) slows down enough to again activate the pressure switch (9) which will allow the flag mast (12) to extend.

Once the flag mast (12) is extended, it will remain extended even if the water vehicle (1) looses power; and this is a safety feature for the present invention. The only way the flag mast (12) will retract in the electromechanical embodiment of the Automatic Safety Flag is:

1) if the water vehicle (1) goes fast enough to cause a sufficient water pressure change in the pressure switch (9), or 2) if the water vehicle operator depresses the mast lowering button (14), and said button (14) supplies electrical power to the motor (17), to retract the flag mast (12) in order to prepare the water vehicle (1) for storage or for transport on a trailer, or the like.

The electromechanical embodiment of the Automatic Safety Flag may be divided into the following sub-systems, and each sub-system may in-turn be analyzed, sub-categorizing each said sub-system into their respective elements. A kit for the Automatic Safety Flag may be divised using the following classification of sub-systems, or may alternatively be comprised essentially of a different classification of sub-systems. The optimal primary sub-systems in the electromechanical embodiment of the Automatic Safety Flag follow:

1. The flag mast (12) and motor assembly (15), which is generally one assembled unit, similar in some respects to the power antenna used in some automobiles, such as, e.g., a. General Motors power antenna assembly part number 22138193. In a preferred electromechanical embodiment of the Automatic Safety Flag, the mast (12) may be composed essentially of stainless steel or a plastic. It may, in some other embodiments, be composed essentially of brass, bronze, or some other metal, alloy, or composite material compatible with long time exposure to a marine or ocean environment. In other embodiments, said mast (12) and motor assembly (15) may be composed essentially of a similar metal, alloy, composite material, or a compatible polymeric material, such as ABS or high desity polyethylene. The mast (12) and motor assembly (15) is optimally located toward the front of the water vehicle (1), and in a hollow recepticle, well, or area in the vehicle's hull. A safety flag (13) is attached to the terminal end of the optionally telescoping flag mast (12) at two or more points. The safety flag (13) is optimally composed essentially of a natural product, such as cotton or silk, or of a polymeric or elastomeric material, such as nylon. The electrical power to the electric motor (17) in the mast motor assembly (15) is optimally supplied by a 12 Volt battery (18), which may be located anywhere within the hull of the water vehicle (1), but is optimally located in the rear of said water vehicle (1). There is an electrical ground (19) or the like, electrically connected to the mast motor assembly (15) on one end, or a segment, of said ground (19), and the other end of the ground (19) being connected to the negative terminal of said 12 Volt battery (18).

2. The mast cover (21) is optimally composed essentially of a material similar to that of the mast (12) and the motor assembly housing (16), but in some primary embodiments, may be composed essentially of a polymeric or elastomeric material. The mast cover (21) is optimally located on the top of the mast opening (20) on the water vehicle's (1) hull. This mast cover (21) may optionally hinge as the mast (12), with the safety flag (13) attached thereto, goes up and down. This mast cover (21) may also seal the motor assembly housing (16) and hull below, from undesired water, dirt, and the like. The mast cover (21) may also be a ball or the like attached to the terminal end of the flag mast (12), and when the flag mast (12) is in the down position, it affects a ball and seat seal, the seat being an O-ring or gasket, or the like, affixed around the perimeter of the mast opening (20), and said ball having a diameter greater than the diameter of the mast opening (20). This O-ring or gasket also functions as seal or barrier, to prevent water from entering the mast assembly (15) and thereby entering the vehicle's (1) hull, when the flag mast (12) is in the up position and the mast cover (21) is up.

3. The water catch device (3) is optimally composed essentially of a polymeric or elastomeric material, such as ABS, but in some embodiments, may be composed essentially of a metal or alloy, such as stainless steel. The water catch port (5) is optimally located at the rear of the water vehicle (1), and on the bottom exterior of said vehicle (1). There are a number of embodiments for the water catches (3) that may be used. A speedometer arm (56) for an outboard motor boat, which drives a speedometer through water pressure, may be used. A length of tubing (6) to catch water (2) at one end, and where such resultant water pressure is directed to a transducer (57), calibrated to determine the water vehicle's (1) velocity may be functional in most aquatic environments. This water catch tubing (6) should have a conical or frusto-conical funnel-like fitting attached thereto at the terminal end and may additionally have a screen attached near the terminal end, and smaller end of said fitting, and attached to the inlet end of said tubing (6).

4. The pressure switch (9), which may be a hydro-mechanical switch, may be located anywhere inside the hull of the water vehicle (1), but is optimally located inboard, and toward the rear of said vehicle (1). The pressure switch (9) itself may be calibrated by means of an adjusting screw (22) and spring (23) on the water side of said switch (9).

5. There is a length of tubing (6) connecting the above-described water catch device (3) with the above-described pressure switch (9). Said tubing (6) is optimally composed essentially of a polymeric or elastomeric material, such as plastic.

6. The above-mentioned pressure switch (9) is, in turn, connected electrically to the water vehicle's engine ignition switch (10), which energizes the motor (17) in the motor assembly (15), which in turn causes the flag mast (12) to rise when the ignition switch (10) is turned on. The flag mast (12) is in the raised position until the speed of the water vehicle (1) is at a predetermined velocity, e.g., 5 MPH or at a wakeless speed, at which time the pressure switch (9) re-energizes the motor (17) in the motor assembly (15) to lower the flag mast (12), into the mast assembly (34), which is located in the water vehicle's (1) hull. When the speed of the water vehicle (1) falls below said predetermined velocity, the pressure switch (9) electrically re-energizes the motor (17) for the motor assembly (15) to raise the mast (12). Another way to lower the mast (12) is to activate a mast lowering button (14), which is normally closed. Activation of this mast lowering button (14) electrically energizes the motor (17) to lower the flag mast (12), and the vehicle's ignition switch (10) must be turned off to keep the mast (12) in the lowered position. When the ignition switch (10) is turned off, it cuts the electrical power to the motor (17) in the motor assembly (15). This mast lowering button (14) is optimally located near the water vehicle's ignition switch (10), and on said vehicle's control panel (27). This mast lowering button (14) is only used to retract the mast (12), e.g., for transport of the water vehicle (1) on a trailer or the like.

The Fluid Mechanical Embodiment

The fluid mechanical embodiment of the present Automatic Safety Flag invention may be divided into the following sub-systems, and each sub-system may inturn be analyzed, sub-categorized and each said sub-system into their respective elements. The primary sub-systems in the fluid mechanical embodiment of the present Automatic Safety Flag invention follow:

1. The water catch device (3) is optimally composed essentially of a polymeric or elastomeric material, such as ABS, but in some embodiments, may be composed essentially of a metal or alloy, such as stainless steel. The water catch port (5) is optimally located at the rear of the vehicle (1), and on the bottom exterior of said vehicle (1). There are a number of embodiments for the water catches (3) that may be used. A speedometer arm (56) for an outboard motor boat, which drives a speedometer through water pressure, may be used. A length of tubing (6) to catch water (2) at one end, and where such resultant water pressure is directed to a transducer (57), calibrated to determine the velocity may be functional in most aquatic environments. This water catch tubing (6) may additionally have a screen or conical or frustoconical funnel-like fitting attached thereto and may additionally have a screen or the like attached to the terminal end, and smaller end of said fitting, and attached to the inlet end of said tubing (6).

2. The impeller housing (45) with the impeller (46) and the protruding gear (50), may comprise one sub-system. The pressurized water (2) entering the impeller housing (45), and driving the impeller (46), thereby drives the protruding gear (50), which is connected to or attached to said impeller (46).

3. The band spring housing assembly (51) with the band spring (52), the spline pulley (55) and mast cable (43). The band spring (52) and the spline pulley (55) are attached to the protruding gear (50), and in a manner so as to affect the raising or the lowering of the flag mast (12), which is connected to the mast cable (43), and said mast cable (43) is attached to the spline pulley (55) on one end, and is attached to the flag mast (12) on the other end. The flag mast (12) may be telescoping, and is a separate component inside the band spring housing assembly (51), may be attached to the band spring housing assembly (51) with a pressed fit from its exterior, or may be attached to said assembly (51) with a threaded or screw connection.

4. The flag mast assembly (34) with the flag (13) and the flag mast (12) is also incorporated into the band spring housing assembly (51), as indicated above in item 3. The flag mast (12) may operate in a manner similar to the automatic radio antenna assembly used in some automobiles, but will be optimally composed essentially of a different material, such as ABS or a composite material. The flag mast (12) will be pushed into the up position or pulled down into the down position by a mast cable (43), which is optimally braided, and which runs through the interior of the hollow flag mast (12), in a preferred embodiment of the Automatic Safety Flag device.

OBJECTIVES AND ADVANTAGES OF THE INVENTION

The objectives and advantages of a simple embodiment of the Automatic Safety Flag invention follow:

1. The present Automatic Safety Flag invention is primarily designed as a safety feature on boats, water vehicles, and the like, by automatically raising a visible safety flag (13) when the water vehicle (1) is motionless or traveling at a low velocity. This visible safety flag (13) serves to alert and warn nearby persons and other water vehicles that the operator's water vehicle (1) with the raised safety flag (13) is motionless or traveling at a low velocity.

2. The present Automatic Safety Flag invention will make it easier for the park and law enforcement authorities to spot and determine violators and potential violators or various rules, regulations, and laws, such as speed laws relating to water vehicles. In a marina, e.g., the violators of a 5 MPH speed limit would be recognized by the absence of the raised safety flag (13).

3. The present Automatic Safety Flag invention would also be helpful to park, law enforcement, and safety authorities during boat races and the like, making motionless and low velocity water vehicles easier to notice and observe. This may be particularly useful in rescue operations.

4. The present Automatic Safety Flag invention would be helpful to other persons and those using other water vehicles in the vicinity of the operator's water vehicle (1) with the Automatic Safety Flag, as they will more easily notice the safety flag (13) equipped water vehicle (1), and thereby more easily avoid a boating collision or accident, and may thereby also be able to provide assistance if needed.

Further objects, features, and advantages of the present invention will become more apparent from the following descriptions of the various embodiments, when taken with the accompanying drawing figures which show, for purposes of illustration only, an embodiment construction in accordance with the present invention.

Description of an Electromechanical Embodiment

Referring now to the drawing figures, the reference numerals used to describe the various parts of the invention are shown following mention of the part of the invention in the specification herein and its appended claims. Like reference numerals are used to refer to like specific parts in the various Figures.

The electromechanical embodiment of the present Automatic Safety Flag invention may be divided into three major categories of components, which are: 1) the water catch (3) and its associated pressure switch (9), 2) the motor (17) and relay circuitry (24), and its housing (16), and 3) the mast assembly (34). In some electromechanical embodiments of the present invention, two or more said major components may be combined into a single major component; e.g., the motor (17), and its housing (16), and the relay circuitry (24), which may be defined as the motor assembly (15).

The water catch (3) may be attached to the rear underside of the water vehicle (1). Said water catch (3) is calibrated to determine the velocity of the water vehicle (1). The water catch (3) is in fluid mechanical communication with a pressure sensitive switch (9), said communication being through the use fluidic pressure caused by water (2) or air, or a combination thereof, and traveling through the hollow water catch tube (6), and whereby the water (2) entering said tube (6) pushes through the tube and compresses the air contained therein. The air pressure being a function of the pressure of the water (2) entering the tube (6), and the water pressure being a function of the water vehicle's (1) velocity. The pressure switch (9) is located in a higher position than the water catch (3), therefore, the tube terminal end (7) attached to the pressure switch (9) is optimally at a higher elevation than said tube end (7), attached to the water catch (3). This optional differential in elevation allows the air in the water catch tube (6) to naturally rise to the highest point, i.e., the end near the pressure switch (9), and inhibits water (2) from approaching the pressure switch (9), by using a diaphram (29) to separate the electrical contact from the pressure side of the pressure switch (9). Said diaphram (29) is optimally composed essentially of a composite, polymeric, or elastomeric material. The pressure switch (9) is optimally contained within a plastic housing (28), which is optimally composed essentially of a composite or polymeric material. Stainless steel is not the desired composition for said housing (28)The diaphram have to electrically insulate it. The diaphram (29) contained within the housing (28) optimally has a protruding notch (30), and said notch (30) is the mechanical communication source between the tube (6) and the pressure switch (9), and is optimally located near the center of the said diaphram (29), and facing the electrical contact (31), and is separated from the electrical contact (31), when there is inadequate pressure to close said contact (31). The protruding diaphram notch (30) is optimally composed essentially of a composite, polymeric, or elastomeric material. The diaphram (29) is contained within the pressure switch housing (28), and said diaphram (29) may move along one axis within said housing (28). When there is sufficient water or air pressure on the diaphram (29), the diaphram (29) moves toward the electrical contact (31) and the protruding diaphram notch (30) makes mechanical contact with said electrical contact (31), thereby forcing the electrical contact (31), which is spring loaded and moves in a linear manner and generally about one axis, and similar to a simple electrical key, to close the electrical contact (31), thereby closing and completing an electrical circuit. The pressure switch (9) may be calibrated through the use of an adjusting screw (22), which adjusts the spring (23) pressure in the pressure switch (9), and allows the manufacturer or the user of the water vehicle (1) to adjust the sensitivity of the of said switch (9) to make electrical contact at higher or lower water velocities. The pressure switch (9) has two ends, the closed end being connected to and in electrical communication with the electrical relay (24), and the open end of the pressure switch (9), and which is closed when pressure is applied, is attached to the water vehicle's (1) ignition system (10), and which is optimally powered by a 12 Volt battery (18), and said battery (18) powering the electrical motor (17). The present electromechanical embodiment does not function without the ignition system (11) being turned on.

The relay circuitry (24) is a double relay, and typically with six electrical terminals (25) and electrical wiring connecting each terminal (25) to its associated electrical connector (26). A function of this double relay is to allow the polarity to drive an electrical motor (17) in two axis of rotation, polar and reversed polar drive. In a simple embodiment, the six electrical terminals (25) of said relay are connected to 1) the battery's (18) negative post or an electrical ground (19) for the electric motor (17) to the relay circuitry (24), 2) the closed end (33) of the pressure switch (9), 3) the open end (32) of said pressure switch (9), 4) the ignition switch (10), which also supplies power to the mast lowering button (14), 5) the electric motor (17), and 6) another ground, entitled the reversed polarity ground (44), for the reversed polarity of the electrical line from to the relay circuitry (24) to the electrical motor (17).

The mast assembly (34) is driven up and down by an electric motor (17), which is optimally between one fifth horsepower and a one horsepower motor (17) in a simple electromechanical embodiment for the typical water vehicle (1), and depending upon the size of the flag mast (12), with the larger mast (12) typically being used on the larger water vehicles (1). The shaft (35) of this electric motor (17) has a worm gear (36), attached thereto and protruding therefrom, which turns when the electric motor (17) is on, and turns in either a clockwise or a counter-clockwise position, depending upon the polarity from the electrical relay circuitry (24). The teeth (37) of the worm gear (36) are matedly in mechanical communication with the teeth (39) of a circular gear (38). The circular gear (38) may rotate in a clockwise or a counter-clockwise position, depending upon the rotation of said worm gear (36). There is a cam (41) located on the surface of said circular gear (38), which is in mechanical communication with a counting device (42), and which counts the number of rotations of said cam (41), and which is set to stop the rotation of said circular gear (38), after a predetermined number of rotations, and that pre-determined number of rotations being the number of rotations needed to raise the safety flag (13) located and affixed to the top of the flag mast (12). When the electrical polarity is reversed, the worm gear (36) will rotate in the opposite direction, thereby causing the circular gear (38) to rotate in the opposite direction, and after a pre-determined number of rotations, the circular gear (38) will stop, and the pre-determined number of rotations being that needed to lower the safety flag (13), located and affixed to the top of the mast (12). The circular gear (38) stops due to a cam (41) or the like, which is in contact with a counting device (42) the only rotates a predetermined number of times before it locks, thereby stopping the rotation of the circular gear (38). The electromechanical embodiment of the Automatic Safety Flag invention can be devised or wired so that either positive or negative polarity may used for raising or lowering the safety flag (13).

There is a water proof or water resistant motor assembly housing (16), covering the electrical motor (17), the worm gear (36), and the circular gear (38) with its cam (41) and the cam's associated counting device (42). There is a water sealed opening in said housing (16) where the mast assembly (34), located outside said housing (16), and is attached to said circular gear (38), with a mast cable or wire (43), attached to the circular gear (38) and wound around said circular gear (38), on one end, and attached to the mast assembly (34) at the terminal end of the flag mast (12). Said mast cable or wire (43) may be composed essentially of stainless steel or of a composite or polymeric material, such as plastic or nylon. The safety flag (13) is attached to and affixed to the top of the flag mast (12), and said safety flag (13) may be permanently affixed to the top of said mast (12) or may be removeable. Said safety flag (13) is optimally attached to the top of the flag mast (12) with an attaching means, such as clips on the flag (13) and rings on the top of said mast (12).

The safety flag (13) attached to the flag mast (12), is raised or lowered, dependant upon the speed of the water vehicle (1), and as determined by the water pressure in the water catch tube (6) or a speedometer or the like.

This section describes how the various elements, subsystems, or components of an electromechanical embodiment of the Automatic Safety Flag invention, are attached, connected, or assembled together to install said invention in a water vehicle (1).

When the present electromechanical embodiment of the Automatic Safety Flag invention is assembled or installed, it will be referred to as the electromechanical embodiment of the Automatic Safety Flag invention. When the present electromechanical embodiment of the Automatic Safety Flag invention is not yet assembled or installed, but some of its essential elements or components may be pre-assembled or pre-packaged as a kit or the like, it will be referred to as the electromechanical embodiment of the Automatic Safety Flag kit. Said kit would not generally include the water vehicle (1), the water vehicle's ignition system (10), and other elements or components that are generally also an essential element or component of said water vehicle (1). The components of the electromechanical embodiment of the Automatic Safety Flag kit may also be collected or purchased separately, and assembled into an Automatic Safety Flag invention.

The electromechanical embodiment of the Automatic Safety Flag device, or a part thereof, may be installed by a manufacturer of the water vehicle (1). The electromechanical embodiment of the Automatic Safety Flag kit may be assembled and installed by a water vehicle (1) manufacturer or dealer, or may be purchased separately from the water vehicle (1), and as a kit, at a boating or sporting supply shop, for installation as a retro-fit kit.

The essential elements or components of the present Automatic Safety Flag kit may be acquired individually or separately, and such collection of the essential elements or components of an Automatic Safety Flag kit, and for eventual use as an Automatic Safety Flag device, is also intended to constitute the claimed Automatic Safety Flag invention.

A simple embodiment of the electromechanical embodiment of the Automatic Safety Flag kit may include the following three sets of elements or components, and each with their various associated attachments or components, if any:

1) The mast motor assembly (15) and housing (16), which may include the relay circuitry (24), and the mast assembly (34) may be included in this set of elements or components, or said mast assembly (34) may be a separate set from the mast motor assembly (15) and housing (16), and would thereby constitute an additional or fourth set.

2. The water catch device (3), and its essential components, which includes the water catch tube (6), which may be glue fitted to said water catch device (3), and the pressure switch (9).

3. The mast assembly (34), and its essential components, including the flag mast (12) and mast cover (21), the mast cable (43), and the safety flag (13).

Other embodiments of the electromechanical Automatic Safety Flag kit may have the elements or components of the invention clustered, pre-assembled, or sub-divided in a varying manner to that example described above.

Description of a Fluid Mechanical Embodiment

In another embodiment of this invention, the Automatic Safety Flag device, may be comprised essentially of mechanical apparatus, and without an electrical power source, ignition switch, or electrical circuitry. This embodiment is powered by fluidic pressure, and is not dependent upon any electrical power source or circuitry. This simplified fluid mechanical embodiment of the Automatic Safety Flag invention has fewer parts and is easier to troubleshoot and service. This simplified fluid mechanical embodiment is also less costly to manufacture and to install into the water vehicle (1).

This embodiment may be comprised essentially of three sets of parts or components:

1) the water catch device (3) with water catch tube (6), which directs water (2) to the inlet end of the impeller housing (45), 2) the impeller housing (45) with impeller (46) and protruding gear (50), 3) the band spring (52), the band spring housing assembly (51) with spline pulley (55) and mast cable (43), and 4) the flag mast assembly (34) with safety flag (13).

The water catch device (3) is optimally composed essentially of a polymeric or elastomeric material, such as ABS, but in some embodiments, may be composed essentially of a metal or alloy, such as stainless steel. The water catch port (5) is optimally located at the rear of the vehicle (1), and on the bottom exterior of said vehicle (1). There are a number of embodiments for the water catches (3) that may be used. A length of tubing (6) to catch water (2) at one end, and where such resultant water pressure is directed to a transducer (57), calibrated to determine the velocity may be functional in most aquatic environments. This water catch tubing (6) may additionally have a screen or conical or frustoconical funnel-like fitting attached to the terminal end, and the smaller end of said fitting, attached to the inlet end of said tubing (6).

The impeller housing (45) may be composed essentially of a composite or polymeric material, such as ABS, which would be compatible with wet environments, and is sufficiently hard to endure the high water pressures and the like, that recreational water vehicles are subjected to. Said impeller housing (45) holds an impeller (46) with a gear (50) protruding from the back end of said housing (45). The impeller housing (45) has a water inlet port (47) and a water outlet port (48), the pressurized water entering the inlet port (47) and thereby turning the impeller blades (49) and thereby powering the impeller (46). The pressurized water powering the impeller (46) then exits the impeller housing (45) through the water outlet port (48), which is in fluidic communication with the water (2) in the impeller housing (45), and said water outlet port (48) may be comprised of a length of tubing or a pipe or channel, or the like, traveling to the outside of the water vehicle's (1) hull, and thereby directing the water (2) to the outside of said vehicle's (1) hull.

Attached to the front end of the water inlet port (47) is a tightly or matedly fit water catch device (3), which catches water (2), typically under the water vehicle's (1) hull, and directs the pressurized water into the water inlet port (47) and through the water catch tube (6), and then into the impeller housing (45), thereby turning the impeller blades (49), as stated above. The water catch device (3) is comprised essentially of the water catch tube (6) and the water catch port (5). Said tube (6) is optimally flexible and may be curved, and the terminal, output end of the tube (6) being matedly fit onto the intake end of the impellor housing (45), with a screw fitting, glue fitting, or the like, and the opposite, front, and input end of said tube (6) being fit onto or into the water catch port (5), with a screw fitting, glue fitting, or the like. In some embodiments of the fluid mechanical Automatic Safety Flag invention, the water catch tube (6) is fit into the water catch port (5), rather than onto or over a portion of said port (5), as said tube will be more secure if a glue fitting is used to attach said tube (6) into the water catch port (5). In some other embodiments, the water catch port (5) could also be barbed or ribbed, to securely fit a water catch tube (6) fit over said port (5), and without a glue fitting necessary. The front, input portion of said water catch device (3) is optimally curved and the front end of said catch device (3) is generally in-line with the path of the water (2) exiting the jet drive of the water vehicle's (1) engine or attached to the bottom of said water vehicle (1), to catch water (2) while the water vehicle (1) is in motion. This allows the Automatic Safety Flag device to be used with a jet drive water vehicle (1) or a conventionally powered water vehicle (1) which does not have a jet drive. When the water vehicle (1) is in motion, the jet drive is effectively pumping or forcing water (2) into the front end of the water catch device (3), and forcing water (2) into the water inlet port (47), and through a water catch tube (6), thereby powering the impeller (46).

The gear (50) protruding from the impeller housing (45) and attached to and powered by said impeller (46), is inserted into a spline pulley (55), geared pulley, or a keyed pulley, or the like. Said spline pulley (55) is attached to a band spring (52). The band spring (52) has two ends (53, 54), the first end (53) being attached to the impeller housing (45), and the second end (54) is attached to a slot or fitting on the protruding gear (50), so that when said gear (50) turns, it winds up the band spring (52) and turns the spline pulley (55), thereby lowering the flag mast (12). The band spring (52) and the attachment of said band spring (52) to the impeller housing (45) on one end (53) and to the protruding gear (50) on the other end (54), is stronger than the water pressure, when a water vehicle (1) is racing full throttle, therefore the band spring (52) will not break, snap, or become over-stressed or over-strained by said continual pressure, and the ends of said spring (52) will not break off from their fixed positions.

When the water vehicle (1) comes to a stop or slows to a wakeless velocity, or when the water pressure entering the water catch port (5) drops, due to the decreased velocity and its related water pressure in the water inlet port (47), the band spring's (52) stored or loaded energy is used to force up the flag mast (12), by rotating the spline pulley (55) in the opposite direction. The band spring (52) is attached to and thereby positioned between the impeller housing (45) and the spline pulley (55). The band spring (52) has more tension when the water vehicle (1) is in motion, because said spring (52) is being wound-up, thereby allowing the attached flag mast (12) to be lowered. The band spring (52) has less tension when the water vehicle (1) is slowed or stops, because the spring (52) will un-wind, and force the attached flag mast (12) to the up position.

This section describes how the various elements or components of a fluidic powered or fluid mechanical embodiment of the Automatic Safety Flag invention, are attached, connected, or assembled together to install said invention into a water vehicle (1).

When the present fluid mechanical embodiment of the Automatic Safety Flag invention is assembled or installed into a water vehicle (1), it will be referred to as the fluid mechanical embodiment of the Automatic Safety Flag device. When the present fluid mechanical embodiment of the Automatic Safety Flag invention is not yet assembled or installed, but some of its essential elements or components may be pre-assembled and pre-packaged as a kit or the like, to be retrofitted to a water vehicle (1), it will be referred to as the fluid mechanical embodiment of the Automatic Safety Flag kit. Said kit would not generally include the water vehicle (1), the water vehicle's ignition system (11), and other elements or components that are generally also an essential element or component of said water vehicle (1).

The fluid mechanical embodiment of the Automatic Safety Flag device, or a part thereof, may be installed by a manufacturer of the water vehicle (1). The fluid mechanical embodiment of the Automatic Safety Flag kit may be assembled and installed by a water vehicle (1) manufacturer or dealer, or may be purchased separately from the water vehicle (1), and as a kit, at a boating or sporting supply shop, for installation as a retro-fit kit. The components of the fluid mechanical embodiment of the Automatic Safety Flag kit may also be collected or purchased separately, and then assembled into the Automatic Safety Flag device.

This section describes the components of a fluidic powered or fluid mechanical embodiment of the Automatic Safety Flag, and how said components, which may be acquired by the user as a kit or the like for retro-fitting into or onto a water vehicle (1), may be assembled to function as an Automatic Safety Flag device.

The essential elements or components of the fluid mechanical embodiment of the Automatic Safety Flag kit may be acquired individually or separately, and such collection of the essential elements or components of an Automatic Safety Flag kit, and for eventual use as an Automatic Safety Flag device, is also intended to constitute the claimed Automatic Safety Flag kit.

A simple embodiment of the fluid mechanical embodiment of the Automatic Safety Flag kit may typically include the following three sets of elements of components, and each with their associated attachments or components, if any:

1) The impeller housing (45) with impeller (46) and mast assembly (34), and which may be comprised of one or more pre-assembled parts.

2) The water catch device (3), with the water catch tube (6), and its essential components, including a connector, or the like, to the impeller housing (45); and said connector may be attached with a threaded screw fitting, a pressed fit connector, or a glue fitting, or a combination thereof, and which is utilized for attaching said tube (6) to the impeller housing (45).

3) The mast assembly (34), which includes the flag mast (12), safety flag (13), and mast cable (43).

Other embodiments of the fluid mechanical Automatic Safety Flag kit may have the elements or components of the invention clustered, pre-assembled, or sub-divided in a varying manner to that example described above.

Additional Embodiments of the Invention

There may be modifications, changes, and variations of the above described embodiments, e.g., by incorporating another type of speedometer into the described embodiment, but other types of speedometers are more complicated and are thereby more prone towards mechanical failure, and more complicated speedometers may be more expensive to manufacture and install.

The disclosed Automatic Safety Flag invention may be attached to the water vehicle (1) along said vehicle's (1) side, or alternatively, on the rear end of said vehicle (1), or the disclosed Automatic Safety Flag device may be built or incorporated into the inside of the hull of the water vehicle (1), and similarly along the side or onto the rear end of said vehicle (1).

While we have shown and described in this disclosure only selected embodiments in accordance with the present invention, it is understood that the same is not limited thereto, but is susceptible to numerous changes and modifications as known to one having ordinary skill in the art, and we therefore do not wish to be limited to the details shown and described herein, but intend to cover all such modifications, changes, and eliminations, as are encompassed by the scope of the appended claims.

We claim:

1. An electromechanical Automatic Safety Flag kit for a water vehicle, comprised essentially of:

a. a mast motor assembly and housing, which includes a electric motor, a relay circuitry, and a mast assembly with a mast cable and the flag mast;

b. a water catch device;

c. a water catch tube;

d. a pressure switch; and e. a mast lowering button, the water catch device including a catch port to catch water when the water vehicle is moving forward, the water catch tube attached to said catch port on one end of said tube, such that water caught in the catch port will be forced into the water catch tube, and said water catch tube is attached to and connected to a pressure sensitive mechanical switch at the terminal end of the water catch tube, whereby when there is sufficient water pressure at said terminal end of the water catch tube, the pressure sensitive mechanical switch will activate said mast motor assembly to raise the flag mast when the vehicle is below a set speed.

2. An electromechanical Automatic Safety Flag kit, as recited in claim 1, wherein one end of said water catch tube is preharnessed to said water catch device.

3. An electromechanical Automatic Safety Flag kit, as recited in claim 1, wherein one end of said water catch tube is preharnessed to said pressure switch.

4. An electromechanical Automatic Safety Flag kit, as recited in claim 1, wherein said mast assembly's flag mast is comprised of a plurality of attached pieces, which extend or retract in a telescoping manner.

5. An electromechanical Automatic Safety Flag kit, as recited in claim 1, wherein there is a safety flag attached to said flag mast.

6. In a water vehicle, an electromechanical Automatic Safety Flag device, comprised essentially of:

a. a water catch device located on the bottom of said water vehicle;

b. a catch port located on said water catch device, such that said port will catch water when the water vehicle is moving forward;

c. a water catch tube attached to said catch port on one end of said tube, such that water caught in the catch port, will be forced into the water catch tube, and said water catch tube is attached to and connected to a pressure sensitive mechanical switch at the terminal end of the water catch tube;

d. a pressure sensitive mechanical switch, that has two electrical contact points, which become electrically connected to a mast motor assembly and to a mast lowering button, respectively, when there is sufficient water pressure at said terminal end of the water catch tube, and said pressure sensitive mechanical switch will activate said mast motor assembly, when said vehicle is wakeless;

e. an ignition switch, that is a component of the water vehicle, and is activated or inactivated by the user turning an ignition key, and said ignition switch is electrically connected to said pressure sensitive mechanical switch, a mast lowering button, an ignition system, a battery, and a mast motor assembly;

f. said ignition system, that is a component of the water vehicle, and which supplies electrical power from the battery to start and operate said vehicle's engine;

g. said battery, that is a component of the water vehicle, and which is the source of electrical power for said vehicle's engine and the mast motor;

h. said mast lowering button, that is electrically connected to both contact points on said pressure switch, and when activated with the ignition will activate the mast motor assembly to lower the flag mast;

i. said mast motor assembly, that is the electrical mast motor and its mechanically attached and electromechanically operated circular gear, and attached relay circuitry;

j. a mast cable, that is attached at one end to said circular gear, and is attached at its other end to the interior of the flag mast and near the terminal end of said flag mast.

7. In a water vehicle, an electromechanical Automatic Safety Flag device, as recited in claim 6, wherein said flag mast is comprised of a plurality of attached pieces, which extend or retract in a telescoping manner, when electrically activated.

8. In a water vehicle, an electromechanical Automatic Safety Flag device, as recited in claim 6, wherein there is a safety flag attached to said flag mast.

9. In a water vehicle, an electromechanical Automatic Safety Flag device, as recited in claim 7, with a light attached thereupon.

10. In a water vehicle, an electromechanical Automatic Safety Flag device, as recited in claim 8, with a light attached thereupon.

11. In a water vehicle, a fluid mechanical Automatic Safety Flag device, comprised essentially of:

a. a water catch device located on the bottom of said water vehicle;

b. a catch port located on said water catch device, such that said port will catch water when the water vehicle is moving forward;

c. a water catch tube attached to said catch port on one end of said tube, such that water caught in the catch port, will be forced into said water catch tube, and the water catch tube is attached to and connected to the water inlet port on an impeller housing;

d. said impeller housing is water tight and houses an impeller;

e. the water flowing through the impeller housing causes said impeller to rotate, and the flowing water exits said impeller housing through a water outlet port;

f. the rotating impeller is attached to a shaft, and said rotating impeller causes said shaft to rotate;

g. the rotating shaft is attached to a band spring, which becomes loaded as a result of said shaft's rotation due to the impeller's rotation;

h. the rotating shaft is also attached to a spline pulley, which turns as a result of the shaft's rotation due to said impeller's rotation;

i. said spline pulley may wind up as a result of rotation of the shaft rotation due to the impeller's rotation, and alternately, the spline pulley may become unwound as the loaded band spring reverses direction and causes the shaft to reverse direction of rotation, due to insufficient water flow through the impeller housing;

j. said spline pulley is attached to one end of a mast cable, and winds up said mast cable as water flow through said impeller housing is causing the impeller to rotate; and k. said mast cable is attached at its other terminal end to the interior of a flag mast and near said flag mast's terminal end, and thereby causes said flag mast to rise or lower, depending upon whether said cable is pushing or pulling, which is determined by the direction of the shaft's rotation; and l. said flag mast, which houses the terminal portion of the mast cable.

12. In a water vehicle, a fluid mechanical Automatic Safety Flag device, as recited in claim 11, wherein said flag mast is comprised of a plurality of attached pieces, which extend or retract in a telescoping manner, when electrically activated.

13. In a water vehicle, a fluid mechanical Automatic Safety Flag device, as recited in claim 11, wherein there is a safety flag attached to said flag mast.

14. In a water vehicle, a fluid mechanical Automatic Safety Flag device, as recited in claim 12, with a light attached thereupon.

15. In a water vehicle, a fluid mechanical Automatic Safety Flag device, as recited in claim 13, with a light attached thereupon.

* * * * *